US008527281B2

(12) United States Patent
Rutten et al.

(10) Patent No.: US 8,527,281 B2
(45) Date of Patent: Sep. 3, 2013

(54) METHOD AND APPARATUS FOR SCULPTING SYNTHESIZED SPEECH

(75) Inventors: Peter Rutten, Gent (BE); Paul A. Taylor, Edinburgh (GB)

(73) Assignee: Nuance Communications, Inc., Burlington, MA (US)

( * ) Notice: Subject to any disclaimer, the term of this patent is extended or adjusted under 35 U.S.C. 154(b) by 0 days.

(21) Appl. No.: 13/537,995

(22) Filed: Jun. 29, 2012

(65) Prior Publication Data

US 2012/0303361 A1 Nov. 29, 2012

Related U.S. Application Data

(63) Continuation of application No. 10/417,347, filed on Apr. 17, 2003, now abandoned.

(30) Foreign Application Priority Data

Apr. 17, 2002 (GB) ..... 0208813.6

(51) Int. Cl.
*G10L 11/00* (2006.01)
*G10L 13/02* (2013.01)
*G10L 23/00* (2009.01)

(52) U.S. Cl.
USPC ..... 704/278; 704/269; 704/260; 704/258

(58) Field of Classification Search
USPC ..... 704/278, 275, 276, 260, 269, 258
See application file for complete search history.

(56) References Cited

U.S. PATENT DOCUMENTS

| | | | | |
|---|---|---|---|---|
| 5,204,969 | A * | 4/1993 | Capps et al. | 704/278 |
| 5,675,778 | A * | 10/1997 | Jones | 701/1 |
| 5,842,167 | A * | 11/1998 | Miyatake et al. | 704/260 |
| 5,970,455 | A * | 10/1999 | Wilcox et al. | 704/270 |
| 6,185,538 | B1 * | 2/2001 | Schulz | 704/278 |
| 6,339,760 | B1 * | 1/2002 | Koda et al. | 704/278 |
| 6,363,342 | B2 * | 3/2002 | Shaw et al. | 704/220 |
| 6,366,883 | B1 * | 4/2002 | Campbell et al. | 704/260 |
| 6,413,098 | B1 * | 7/2002 | Tallal et al. | 434/185 |
| 6,678,661 | B1 * | 1/2004 | Smith et al. | 704/278 |
| 2003/0088416 | A1 * | 5/2003 | Griniasty | 704/256 |

* cited by examiner

*Primary Examiner* — Pierre-Louis Desir
*Assistant Examiner* — Abdelali Serrou
(74) *Attorney, Agent, or Firm* — Sunstein Kann Murphy & Timbers LLP

(57) ABSTRACT

Methods and systems for sculpting synthesized speech using a graphic user interface are disclosed. An operator enters a stream of text that is used to produce a stream of target phonetic-units. The stream of target phonetic-units is then submitted to a unit-selection process to produce a stream of selected phonetic-units, each selected phonetic-unit derived from a database of sample phonetic-units. After the stream of sample phonetic-units is selected, an operator can remove various selected phonetic-units from the stream of selected phonetic-units, prune the sample phonetic-database and edit various cost functions using the graphic user interface. The edited speech information can then be submitted to the unit-selection process to produce a second stream of selected phonetic-units.

16 Claims, 19 Drawing Sheets

METHOD AND APPARATUS FOR SCULPTING SYNTHESIZED SPEECH

This application is a continuation of co-pending U.S. patent application Ser. No. 10/417,347, filed Apr. 17, 2003, which is incorporated herein by reference.

TECHNICAL FIELD

This invention relates to methods and systems for speech processing and in particular for editing synthesized speech using a graphic user interface.

BACKGROUND ART

As the technology associated with speech synthesis advances, the problems and issues that arise to further advance the art of speech synthesis change with each generation of new technology. For example, early speech synthesis techniques were wrought with a broad range of problems and produced speech having a very poor quality. However, as the overall quality of speech improved, various specific issues became apparent. For instance, while the overall clarity of synthesized speech improved, it was universally noted that such synthesized speech still sounded very "mechanical" in nature. That is, it was recognized that the prosody of the synthesized speech remained poor.

As various techniques were developed to address the prosody issue, and the sophistication of speech synthesis techniques progressed as a whole, mechanically produced voices began to sound less and less mechanical. Unfortunately, the very sophistication that gave rise to non-mechanical sounding artificial voices also gave rise to occasional performance "glitches" that were both unpredictable and unacceptable to a human listener. For example, if an operator desires to synthesize a number of canned messages using a modem speech synthesis device, an average listener may note that, while each resultant synthesized message sounds natural overall, one or two words in each message might be badly formed and sound unnatural or incomprehensible. Accordingly, methods and systems that can selectively fix or "sculpt" the occasional mis-produced word in a stream of synthesized speech are desirable.

SUMMARY

The present disclosure relates to methods and systems for providing synthesized speech and editing the synthesized speech using a graphic user interface. In operation, an operator can enter a stream of text that can be used to produce a stream of target phonetic-units. The stream of target phonetic-units can then be used to produce a stream of respective selected phonetic-units via a unit-selection process that selects phonetic-units on the basis of a at least a set of target-costs between each target phonetic-unit and each respective sample phonetic-unit of a group of sample phonetic-units.

Once a stream of sample phonetic-units is selected, the operator can use a specially configured phonetic editor to designate and remove one or more selected phonetic-units from the stream of selected phonetic-units.

In addition to merely designating/removing phonetic-units, the phonetic editor may optionally be configured to enable an operator to optionally prune groups of phonetic-units.

Further, the phonetic editor may optionally be configured to enable an operator to edit various cost functions relating to any number of function-types, such as pitch, duration and amplitude functions. In various embodiments, the phonetic editor can edit well-known functions, such as a Gaussian distribution, by manipulating those parameters that describe the function. In other exemplary embodiments, the phonetic editor can be configured to edit functions using any number of drawing tools.

By using a combination of editing tools embodied in a graphic user interface, an operator can develop an intuitive feel for the relationships between various phonetic-unit parameters and quality of synthesized speech. Accordingly, such a combination of editing tools can enable the operator to sculpt a portion of synthesized speech in an intuitive and straightforward manner. Others features and advantages will become apparent in the following descriptions and accompanying figures.

According to an aspect of the present invention, there is provided a speech processor, comprising a unit-selection device that processes a stream of target phonetic-units to produce a stream of respective selected phonetic-units, the selected phonetic-units being selected on the basis of at least a set of target-cost functions that determine target-costs between each target phonetic-unit and respective groups of sample phonetic-units; and a phonetic editor configured to enable an operator to selectively designate one or more selected phonetic-units in the stream of selected phonetic-units.

Preferably the phonetic editor is configured so that designation can cause removal of one or more phonetic-units from the stream of phonetic-units. Optionally, the one or more phonetic-units are precluded from re-selection in a subsequent unit selection process.

According to another aspect of the present invention, there is provided a graphic user interface wherein the editing tool is further configured to enable the operator to prune one or more non-selected phonetic-units from a group of phonetic-units, the group of phonetic-units relating to a first removed phonetic-unit.

According to another aspect of the present invention, there is provided a speech processor having a graphic user interface configured to allow graphical editing of at least a first target cost function.

According to another aspect of the present invention, there is provided a speech processor having a graphic user interface configured to allow a graphical comparison of two or more streams of speech.

According to another aspect of the present invention, there is provided a speech processor having a graphic user interface configured to display portions of two or more streams of selected phonetic-units, each phonetic unit including one or more displayed parameters.

According to another aspect of the present invention there is provided a method for processing speech information, comprising selecting a stream of selected phonetic-units from a database of sample phonetic-units, wherein the step of selecting is based on a stream of target phonetic-units with respective target-costs relating to the sample phonetic-units; and performing an editing function on the stream of selected phonetic-units, the editing function including selectively designating one or more selected phonetic-units.

According to another aspect of the present invention there is provided program code means and a program code product for performing the methods described herein.

DETAILED DESCRIPTION

Figure 1:
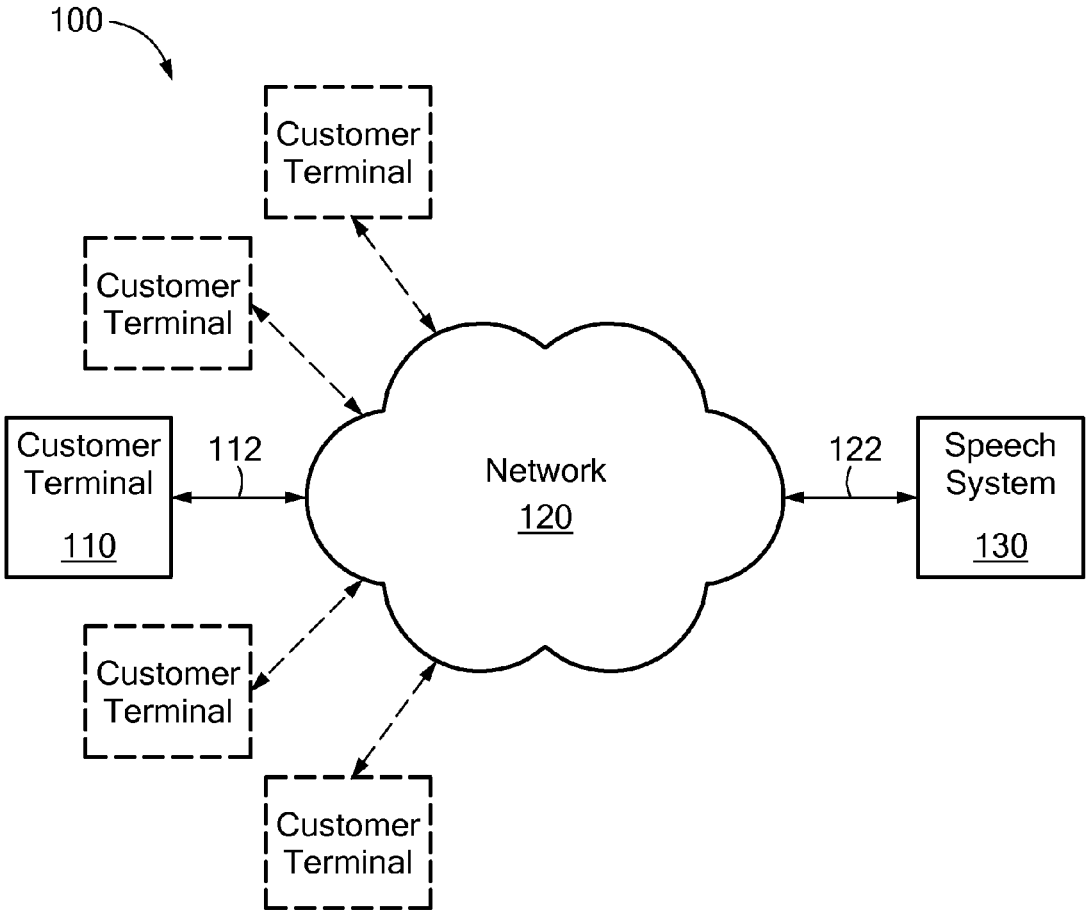
FIG. 1 depicts a communication network using a speech synthesis system.

Various embodiments of the present invention are directed to techniques for . . . . FIG. 1 depicts a communication system 100 capable of transmitting synthesized speech messages according to the present invention. As shown in FIG. 1, the communication system 100 includes a network 120 connected to a customer terminal 110 via link 112, and further connected to a speech system 130 via link 122.

In operation, a customer at the customer terminal 100 can activate various routines in the speech system 130 that, in turn, can cause the speech system 130 to transmit various speech information to the customer terminal 110. For example, a customer using a telephone may navigate about a menu-driven telephone service that provides various verbal instructions and cues, the verbal instructions and cues being artificially produced by a text-to-speech synthesis technique. While the speech system 130 can transmit various speech information, in various embodiments it should be appreciated that the exemplary speech system 130 can be part of a greater system having a variety of functions, including generating synthesized speech information using a text-to-speech synthesis process.

The exemplary network 120 can be a portion of a public switched telephone network (PSTN). However, in various embodiments, the network 120 can be any known or later developed combination of systems and devices capable of conducting speech information, voice or otherwise encoded, between two terminals such as a PSTN, a local area network, a wide area network, an intranet, the Internet, portions of a wireless network, and the like. Similarly, the exemplary links 112 and 122 can be subscriber's line interface circuits (SU⁻Cs). However, in various embodiments, the exemplary links 112 and 122 can be any known or later developed combination of systems and devices capable of facilitating communication between the network 120 and the terminals 110 and 130, such as TCP/IP links, RS-232 links, 10 baseT links, 100 baseT links, Ethernet links, optical-based links, wireless links, sonic links and the like.

The terminals 110 and 130 can be computer-based systems having a variety of peripherals capable of communicating with the network 120, and further capable of transforming various signals, such as speech information, between mechanical speech form and electronic form. However, in various embodiments, either of the exemplary terminals 110 and 130 can be variants of personal computers, servers, personal digital assistants (PDAs), conventional or cellular phones with graphic displays or any other known or later developed devices that can communicate with the network 120 over respective links 112 and 122 and transform various physical signals into electronic form, while similarly transforming various received electronic signals into physical form.

Figure 2:
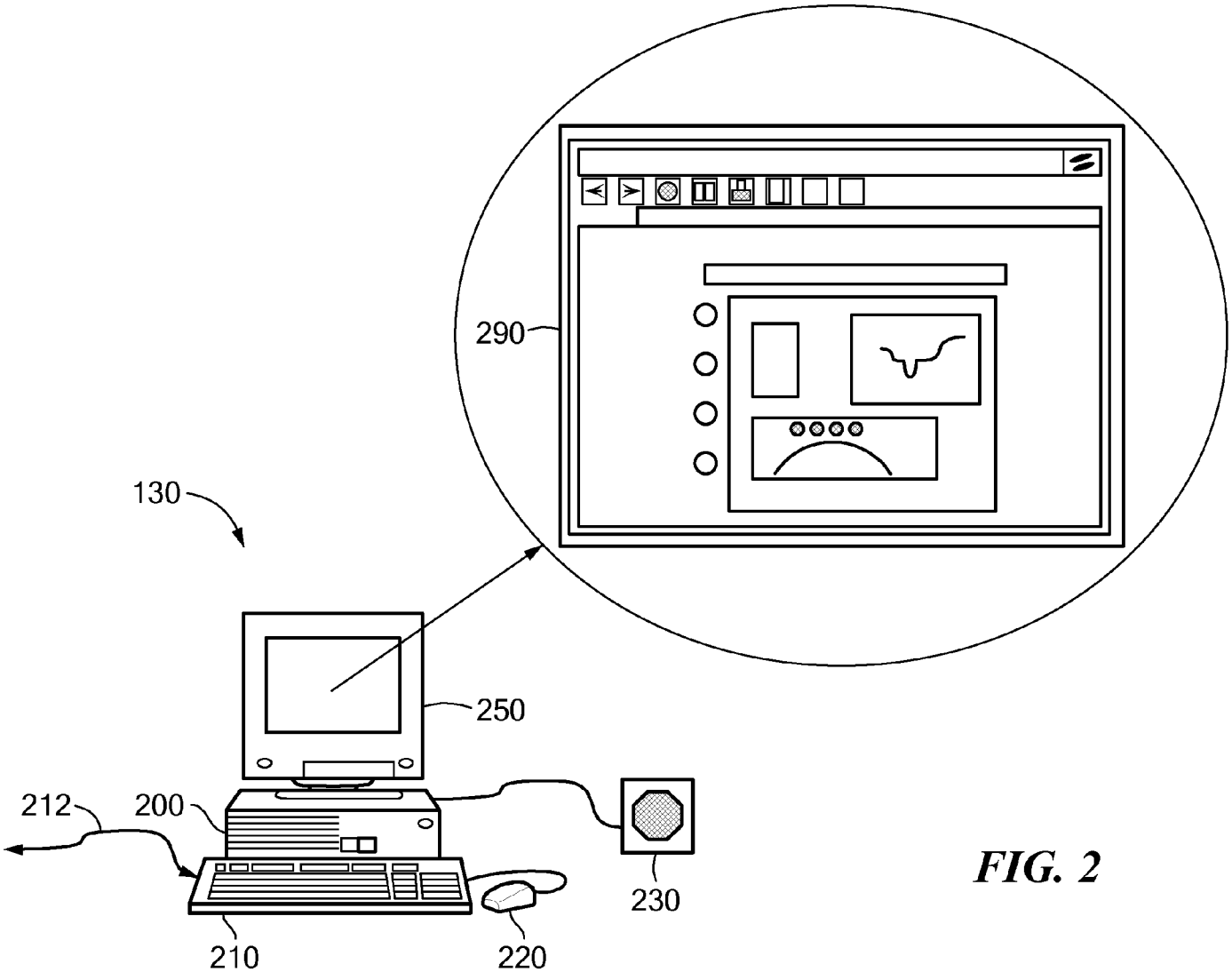
FIG. 2 depicts the speech system of FIG. 1 using a graphic user interface.

FIG. 2 depicts an exemplary embodiment of the speech system 130 of FIG. 1. As shown in FIG. 2, the speech system 130 includes a personal computer 200 having a keyboard 210, a mouse 220, a speaker 230 and a monitor 250. Also shown in FIG. 2, the personal computer 200 can be connected to a network, such as a PSTN or the Internet, via link 212.

The exemplary speech system 130 can convert text to speech that, in turn, can be played locally or transmitted to a distant party over a network. To synthesize speech from text, an operator using the personal computer 200 can first enter a stream of text into the speech system 130 using the keyboard 210. After the operator enters the text stream, the operator can command the speech system 130 to convert the text stream to a stream of speech information using a graphic user interface (GUI) 290 (displayed on the monitor 250), the keyboard 210 and the mouse 220.

After the speech is synthesized, it should be appreciated that the operator may desire to listen to and rate the quality of the synthesized speech. Accordingly, the operator may command the personal computer 200 to play the stream of synthesized speech via the GUI 290, and listen to the synthesized speech via the speaker 230.

Assuming that the operator determines that the synthesized speech is not satisfactory, the operator can edit, or "sculpt", various portions of the synthesized speech information using the GUI 290, which can provide various virtual controls as well as display various representations of the synthesized speech. The exemplary speech system 130 and GUI 290 are configured to allow the operator to perform various speech editing functions, such as editing/removing various phonetic information from the stream of speech information as well as manipulate various functions related to phonetic selection. However, the particular form of phonetic editing functions can vary without departing from the scope of the present invention as defined in the claims.

Figure 3:
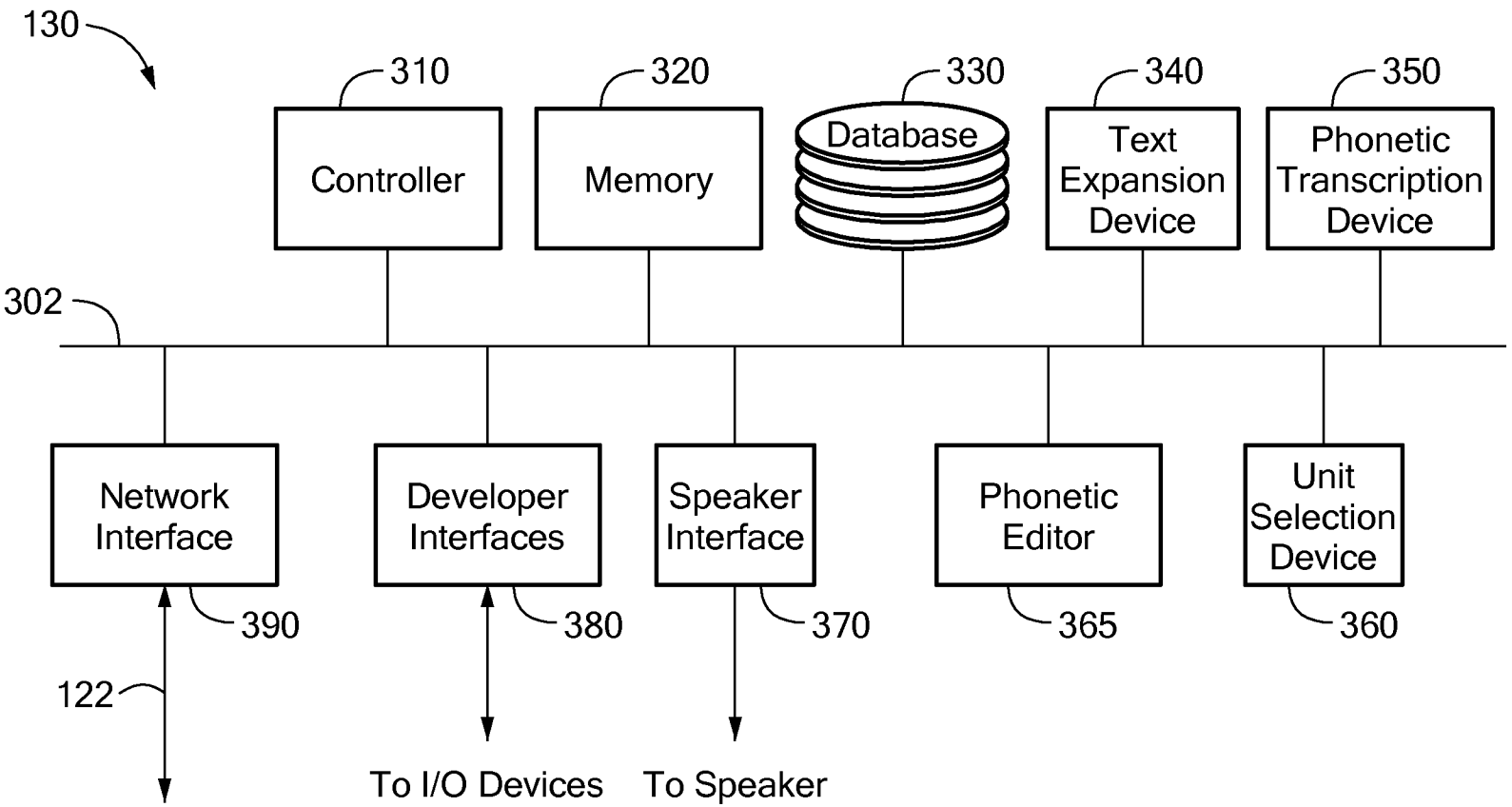
FIG. 3 depicts the computer system of FIG. 2.

FIG. 3 depicts the exemplary personal computer 200 of FIG. 2. As shown in FIG. 3, the personal computer includes a controller 310, a memory 320, a database 330, a text expansion device 340, a phonetic transcription device 350, a unit-selection device 360, a phonetic editor 365, a speaker interface 370, a set of developer interfaces 380 and a network interface 390. The above components are coupled together using a control/data bus 302.

Although the exemplary personal computer 200 uses a bussed architecture, it should be appreciated that the functions of the various components 310-390 can be realized using any number of architectures, such as architectures based on dedicated electronic circuits and the like. It should further be appreciated that the functions of certain components, including the text expansion device 340, the phonetic transcription device 350, the unit-selection device 360 and the phonetic editor 365, can be performed using various programs residing in memory 320.

In operation and under control of the controller 310, the personal computer 200 can receive a stream of text information from an operator using the set of developer interfaces 380 and store the information into the memory 320. The exemplary set of developer interfaces 380 can include any number of interfaces that can connect the personal computer 200 with a number of peripherals useable to computers, such as keyboards, computer-based mice, monitors displaying GUI pages and the like. The particular composition of the developer interfaces 380 can therefore vary according to the particular desired configuration of a larger speech synthesis system.

While the exemplary personal computer 200 synthesizes speech from standard alpha-numeric text, it should be appreciated that, in various embodiments, the personal computer 200 can operate on any form of information that can be used to represent information, such as a stream of symbols representing phonetic information, digitized samples of speech, a stream of compressed data, binary representations of text and the like, without departing from the scope of the present invention as defined in the claims.

Once the stream of text information is received, the controller 310 can provide the text information to the text expansion device 340. The text expansion device 340, in turn, can perform any number of well know or later developed text expansion operations useful to speech synthesis, such as replace abbreviations with full words. For example, the text expansion device 340 could receive a stream of text containing the string "Mr." and substitute the string "mister" within the text stream.

After the text stream is expanded, the text expansion device 340 can provide the expanded text stream to the phonetic transcription device 350. The phonetic transcription device 350, in turn, can convert the stream of expanded text to a stream of target phones, diphones or other useful data type (collectively "phonetic-units").

A "phone" is a recognized building block of a particular language. Generally, most languages contain somewhere between forty and fifty phones with each phone representing a particular portion of speech. For example, in the English language the word "look" can be decomposed into its constituent phones {/l/, /00/, /k/}.

In various embodiments, the term "phone" can also refer to portions of phones, such as half-phones, that can represent relatively smaller portions of speech. For the example above, the word "look" can be also be decomposed into its constituent half-phones {/$l_{left}$/, /$l_{right}$/, /$OO_{left}$/, $OO_{right}$/, /$k_{left}$/, /$k_{right}$/}. However, it should be appreciated that the particular nature of a particular phone set can vary as required or otherwise by design without departing from the scope of the present invention as defined in the claims.

In contrast to phones, a "diphone" is a related, but distinctly different, widely-used form for defining the foundational elements of speech. Like a phone, each diphone can contain some portion of speech information. However, unlike a phone, a diphone begins from the central point of the steady state part of one standard phone and ends at the central point of the subsequent standard phone, and contains the transition between the two phones. For the example above, the word "look" can be decomposed into its constituent diphones {/silence-1/, /1-OO/, /OO-k/, /k-silence/} as shown below in Table 1.

TABLE 1

| | | | | |
|---|---|---|---|---|
| phone centerpoint /silence/ | phone centerpoint /1/ | phone centerpoint /OO/ | phone centerpoint /k/ | phone centerpoint /silence/ |
| <--diphone--> /silence-1/ | <--diphone--> /1- OO/ | <--diphone--> /OO - k/ | <--diphone--> /k-silence/ | |

There are several advantages of using diphones for speech synthesis. For example, the point at which the diphones are concatenated is typically a stable steady-state region of a speech signal, where a minimum amount of distortion should occur upon joining. Accordingly, concatenated diphones are less likely to contain various artifacts, such as intermittent "pops", than concatenated phones. Defining an inventory of phones from which diphones can be constructed, and then defining the ways in which such phones can and cannot be concatenated to form diphones is both manageable and computationally reasonable. Assuming a phonetic inventory between forty and fifty phones, a resulting diphone inventory can number less than two-thousand. However, such figures are intended to be illustrative rather than limiting.

Given phones/diphones are recognized as portions of speech, it should be appreciated that a "target phone" can refer to any phone having a respective specification, such specification including a number of parameters. Similarly, a "target diphone" can refer to any diphone having a respective specification, such specification including a number of parameters. More generally, a "target phonetic-unit", whether it be phone, diphone or some other form of audio information useful for expressing speech information, can refer to any "phonetic-unit" having a respective specification, such specification including a number of parameters relating to audio information, such as pitch, amplitude, duration, stress, etc. By appending a set of parameters to each phonetic-unit, a speech synthesis device can cause a stream of speech to take on various human qualities, such as prosody, accent and inflection.

Returning to FIG. 3, after the phonetic transcription device 350 produces a stream of target phonetic-units, the phonetic transcription device 350 can provide the stream of target phonetic-units to the unit-selection device 360. The unit-selection device 360, in turn, can receive the stream of target phonetic-units, and further receive a group of respective sample phonetic-units from database 330 for each target phonetic-unit.

A "sample phonetic-unit" is a phonetic-unit, e.g., a phone or diphone that is derived from human speech. Generally, a speech synthesis database can contain a large number of sample phonetic-units, each sample phonetic-unit representing a variation of a recognized phonetic-unit with the different sample phonetic-units sounding slightly different from one another. For example, a first sample phone $/OO/_{000001}$ may differ from a second sample phone $/OO/_{000002}$ in that the second sample phone may have a longer duration than the first. Similarly, sample phone $/OO/_{000031}$ may have the same duration as the first phone, but have a slightly higher pitch and so on. A typical speech synthesis database might contain 100,000 or more sample phonetic units.

Again returning to FIG. 3, once the unit-selection device 360 has received the stream of target phonetic-units, along with respective groups of sample phonetic-units, the unit-selection device 360 can select those sample phonetic-units that satisfy a least-cost criteria taking into account target-costs, which embody costs associated between target and sample phonetic-units, as well as join-costs, which embody the difficulty of concatenating two particular phonetic-units while making the resulting combination sound natural. The exemplary unit-selection device 350 selects a concatenated stream of sample phonetic-units using a maximum likelihood sequence estimation (MLSE) technique that itself uses a Viterbi algorithm for efficiency. However, as a large number of varied unit-selection techniques and devices are well known in the relevant industry, it should be appreciated that the particular form of any unit-selection approach can vary as required without departing from the scope of the present invention as defined in the claims.

Once the unit-selection device 350 has produced a stream of selected phonetic-units, the unit-selection device 350 can provide an appropriate signal to the controller 310. The controller 310, in turn, can provide an indication to a GUI via the developer interfaces 380 that the unit-selection process is completed. Accordingly, an operator using the personal computer 200 can manipulate the GUI to play the selected stream of phonetic-units, where upon the unit-selection device 360 could provide the stream of selected phonetic-units to a speaker via the speaker interface 370, or the operator could manipulate the GUI to indicate whether the operator chooses to edit the stream of selected phonetic-units.

Figure 4:
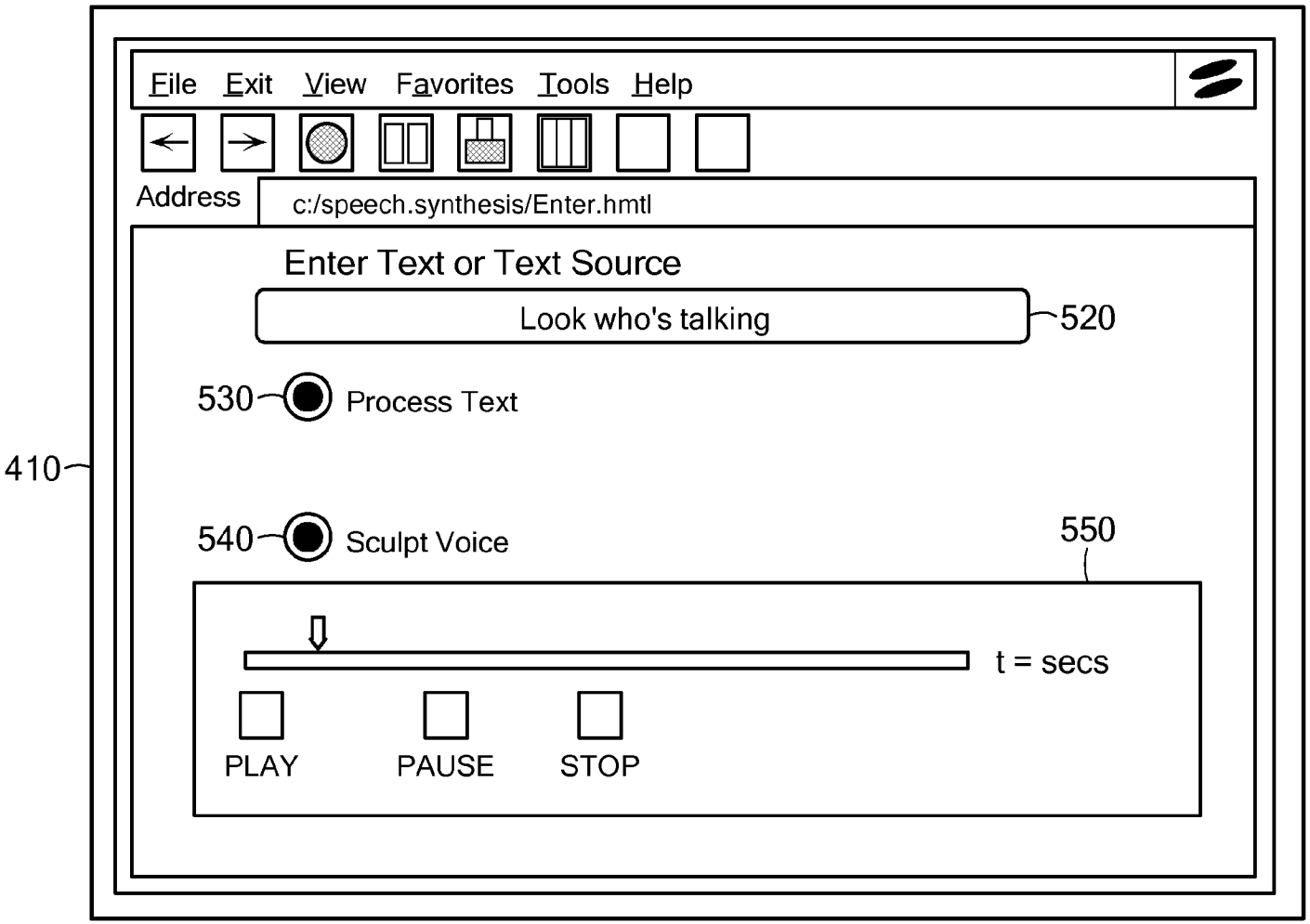
FIG. 4 depicts a first graphic page of the graphic user interface of FIG. 2.

FIG. 4 depicts a first page 410 of a GUI configured to enable an operator to enter a stream of text, process the text to form synthesized speech and play and/or edit the resulting synthesized speech. As shown in FIG. 4, the first page 410 includes a text-entry box 520, a first control 530, a second control 540, and a play panel 550.

In operation, an operator manipulating the text-entry box 520 and first control 530 can generate synthesized speech by first providing a stream of text and subsequently commanding a device, such as a personal computer, to convert the provided text to speech form. The first page 410 is also configured to enable the operator to play the synthesized speech via the play panel 550.

Assuming the operator decides that the synthesized speech is satisfactory, the operator can store the synthesized speech, or desired portions of the synthesized speech, along with all the data used to construct such stored synthesized speech, such as files containing the stream of target phonetic-units used to construct the synthesized speech, the stream of respective selected phonetic-units, lists of removed/pruned phonetic-units (explained below), descriptions of modified cost-functions (also explained below), and so on. Accordingly, the operator can later recall the stored speech for later modification, combine the stored speech with other segments of speech or perform other operations without losing any important work product in the process.

However, assuming that the operator desires to edit the synthesized speech, the first page is configured to enable a device to evoke various speech-editing functions via the second control 540. Returning to FIG. 3, the controller 310, upon receiving an edit command from an operator, can provide the phonetic editor 365 with the target phonetic-units, the respective selected and non-selected sample phonetic-units for each target phonetic-unit and the various related cost functions. The phonetic editor 365, in turn, can receive the information and perform various editing operations according to a number of received instructions provided by an operator while simultaneously updating a GUI page to interactively reflect those changes made.

The preferred phonetic editor 365 can provide a number of phonetic editing operations. For example, the phonetic editor 365 can be configured to designate, i.e., mark, any number of selected phonetic-units from the stream of selected phonetic-units, and optionally remove the designated phonetic-units while optionally precluding the removed phonetic-units from being considered for subsequent selection.

In the preferred and other embodiments, the phonetic editor 365 can not only remove any selected phonetic-units, but can optionally prune any number of non-selected sample phonetic-units from the available database of useable phonetic-units. For example, an operator listening to a portion of synthesized speech may desire designate a particular /OO-k/ diphone, then remove those phonetic-units from consideration from the available stock of sample /OO-k/ diphones. Once designated, the operator may remove those /OO-k/ diphone samples having a given range of pitch such that a final speech product might sound less emphasized. Similarly, the operator may remove/prune all phonetic-units from a particular group of phonetic-units having a long duration to effectively shorten a particular word, and so on.

Once the desired sample/selected phonetic-units are edited, the unit-selection device 360 can again perform a unit-selection process as before with the exception that such subsequent unit-selection process will not consider those phonetic-units specifically removed by the operator. That is, unit-selection can be performed such that unsatisfactory portions of speech will be modified while those portions deemed satisfactory by an operator will remain intact. The process of alternatively performing unit-selection and editing can continue until the operator determines that the speech product is acceptable.

Regarding the process of phonetic-unit editing, FIGS. 5-10 outline an exemplary phonetic-unit selection and editing process. For example, starting at FIG. 5A, a stream of target phones 610-1 . . . 610-5 representing a portion of speech is shown in relation to various groups of respective sample phones designated 620-1 . . . 620-5 respectively. As discussed above, each target phone 610-1 . . . 610-5 can include a specification 611-1 . . . 611-5 and each target phone may be possibly represented by a group of sample phones 620-1 . . . 620-5. For example, as shown in FIG. 5A, target phone 610-2 may be represented by any phone within group 620-2, which includes sample phones 620-2(1), 620-2(2) . . . **620-2(*n*), each sample phone 620-2(1), 620-2(2) . . . 620(*n*) representing a variant of the same target phone 610-2**.

As discussed above, unit-selection can involve finding a least-cost path taking into account various target-costs (represented by the vertical arrows between each target phone 610-1 . . . 610-5 and respective group of sample phones 620-1 . . . 620-5), as well as join-costs (represented by the arrows traversing left to right between sets of sample phones).

The exemplary target-costs can be described by any number of functions, such as a Gaussian distribution. Generally, such target-cost functions are designed to find the closest matches between target phones and respective sample phones as a whole.

Join-costs on the other hand, generally do not relate to the similarity of phones, but instead relate to the difficulty of concatenating various phones so that speech artifacts, such as intermittent "pops", will be minimized. Assuming all of the various cost functions are known, a unit-selection process can provide a least-cost path, such as the exemplary least-cost path shown in bold shown in FIG. 6A that includes sample phones {620-1(1), 620-2(4), 620-3(2), 620-4(3), 620-5(1)}.

Figure 5A:
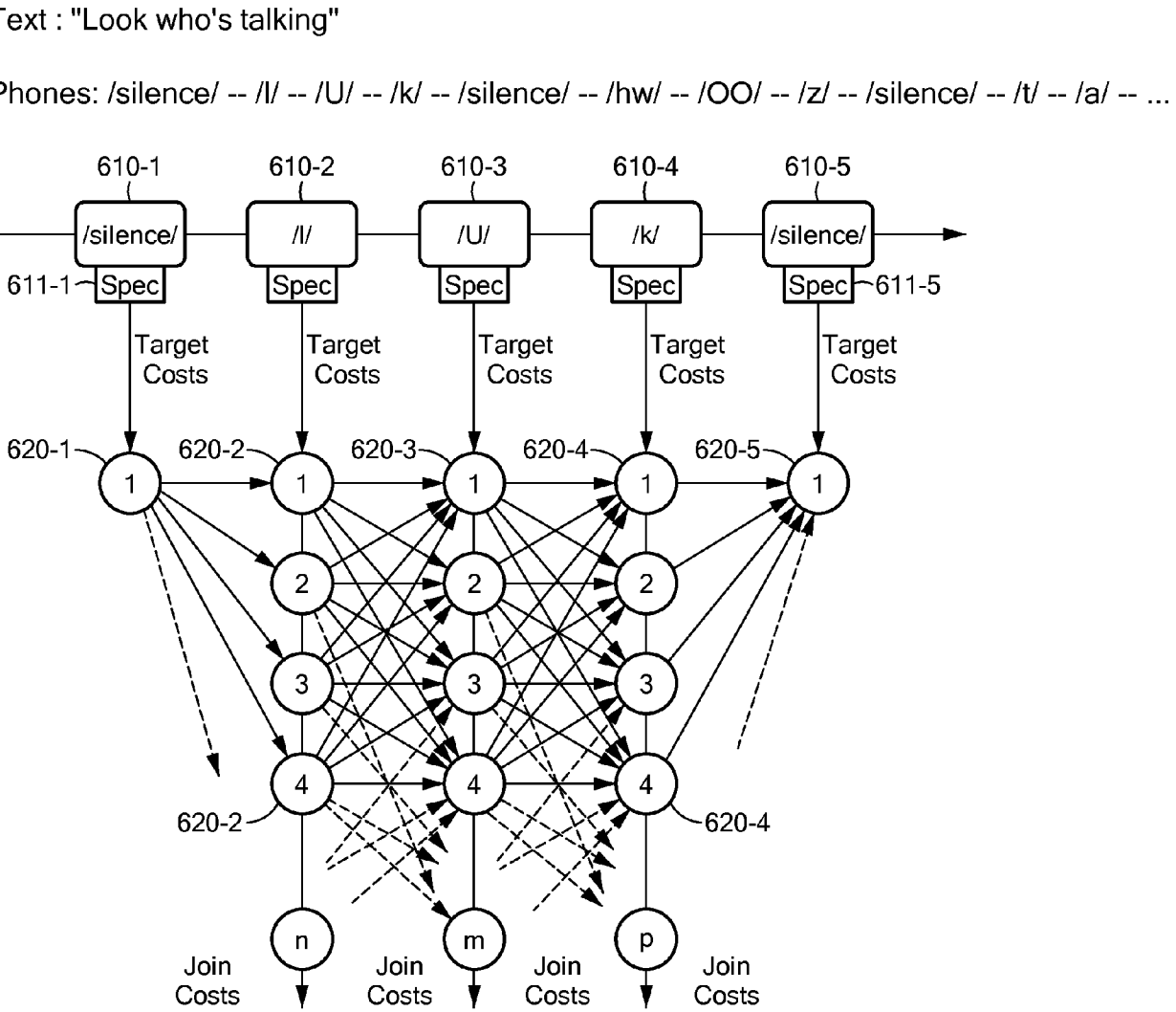
FIG. 5A depicts an exemplary stream of target phones with respective groups of sample phones.
Figure 5B:
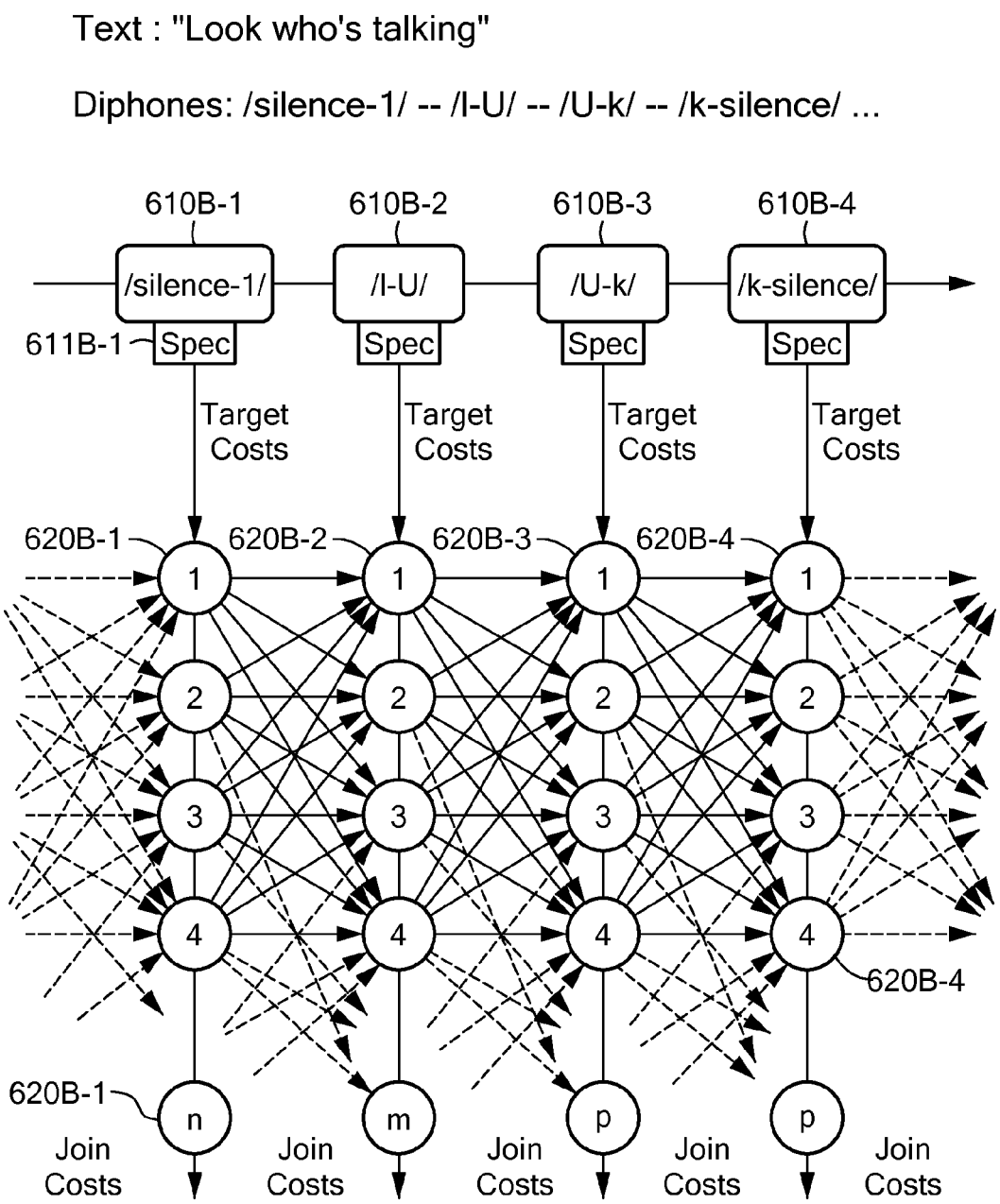
FIG. 5B depicts an exemplary stream of target diphones with respective groups of sample diphones.

As discussed above, in various embodiments other forms of phonetic-units, such as diphones, may also be used by embodiments of the present invention. For example, as shown in FIG. 5B, a stream of target diphones 610B-1 . . . 610B-4 representing a portion of speech is shown in relation to various respective groups of sample diphones 620B-1 . . . 620B-4. As with the phones of FIG. 5A, each target diphone 610B-1 . . . 610B-4 can include a specification 611B-1, each target diphone may be represented by a group of sample diphones 620B-1 . . . 620B-4 and unit-selection can involve finding a least-cost path taking into account various target-costs and join-cost. Again assuming that the cost functions are known, a unit-selection process can provide a least-cost path, such as the exemplary least-cost path {620B-1(1), 620B-2(1), 620B-3(3), 620B-4(3) 1 shown in bold in FIG. 6B.

Figure 6A:
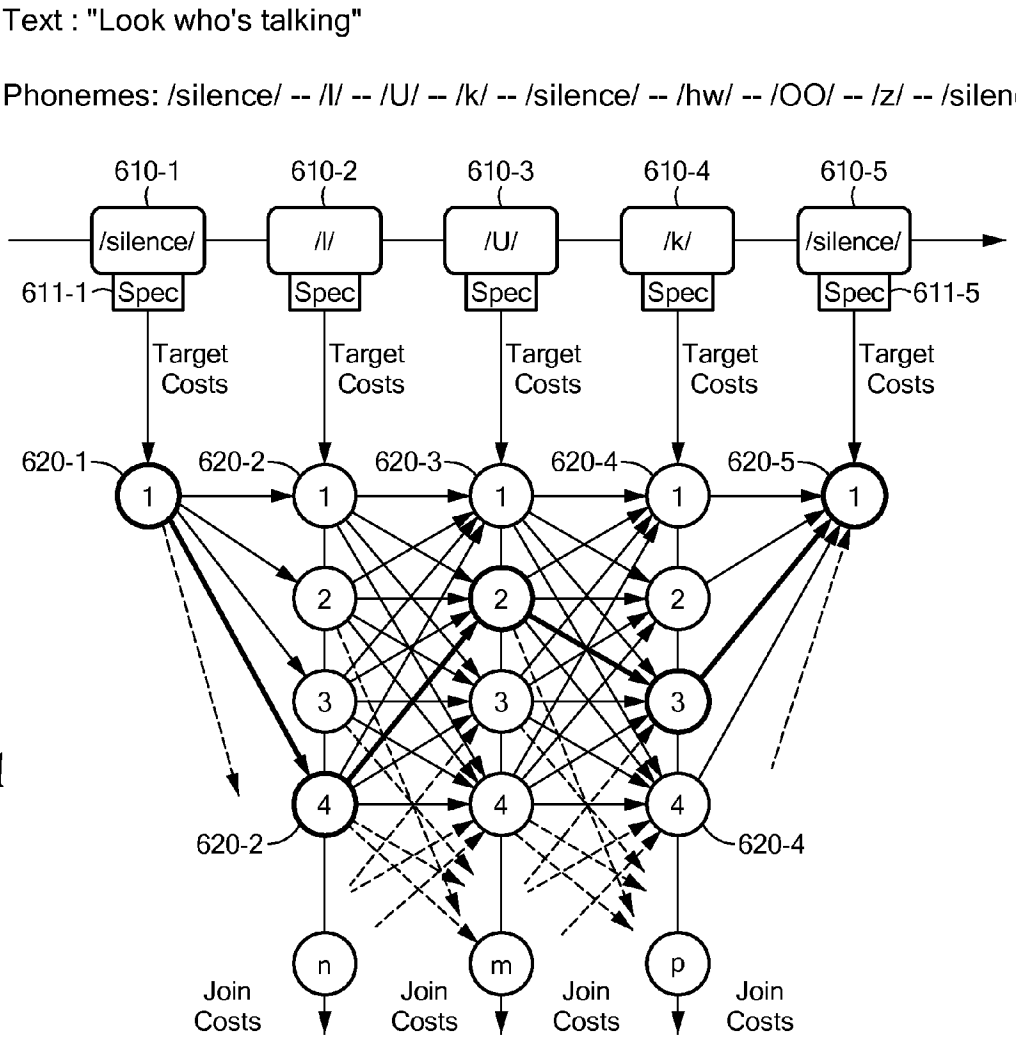
FIG. 6A depicts the exemplary phones of FIG. 5A after a stream of sample phones is selected.
Figure 6B:
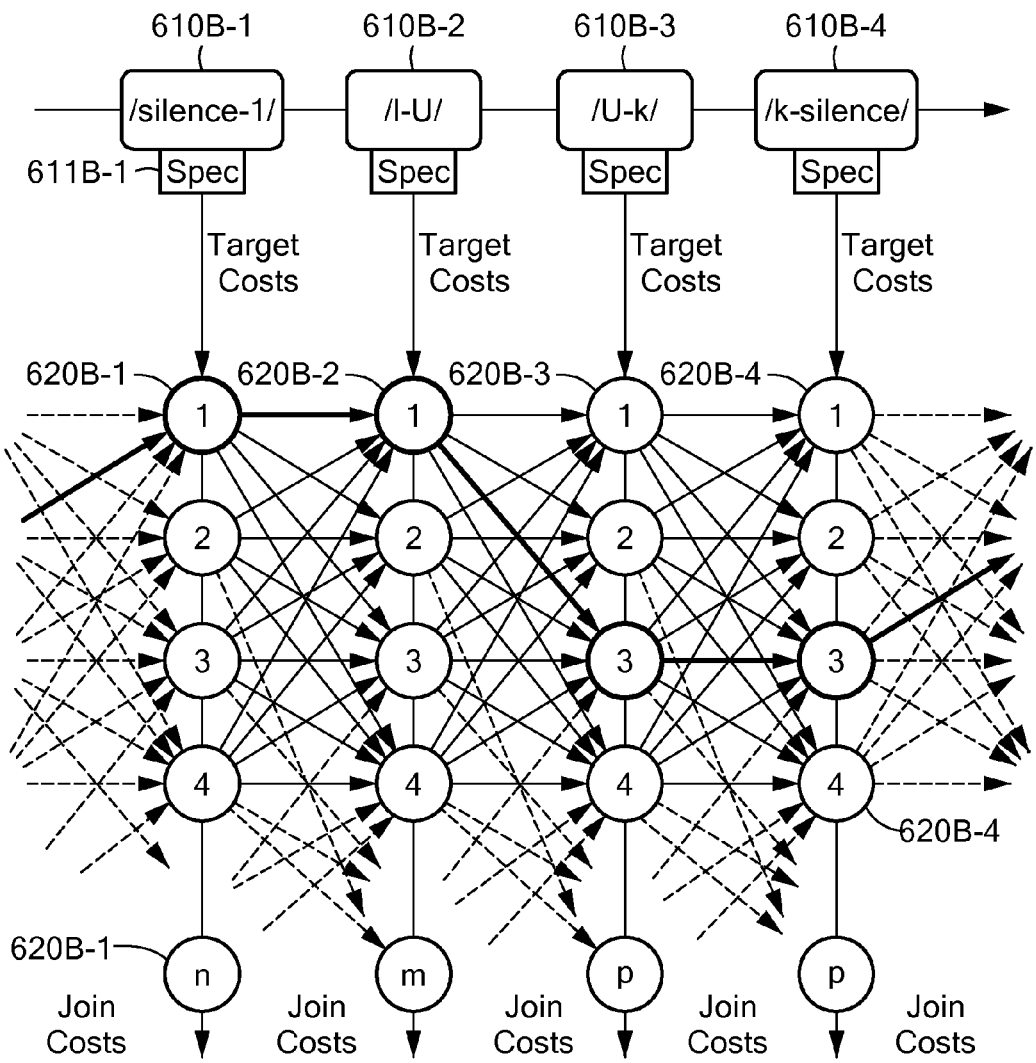
FIG. 6B depicts the exemplary diphones of FIG. 5B after a stream of sample diphones is selected.
Figure 7:
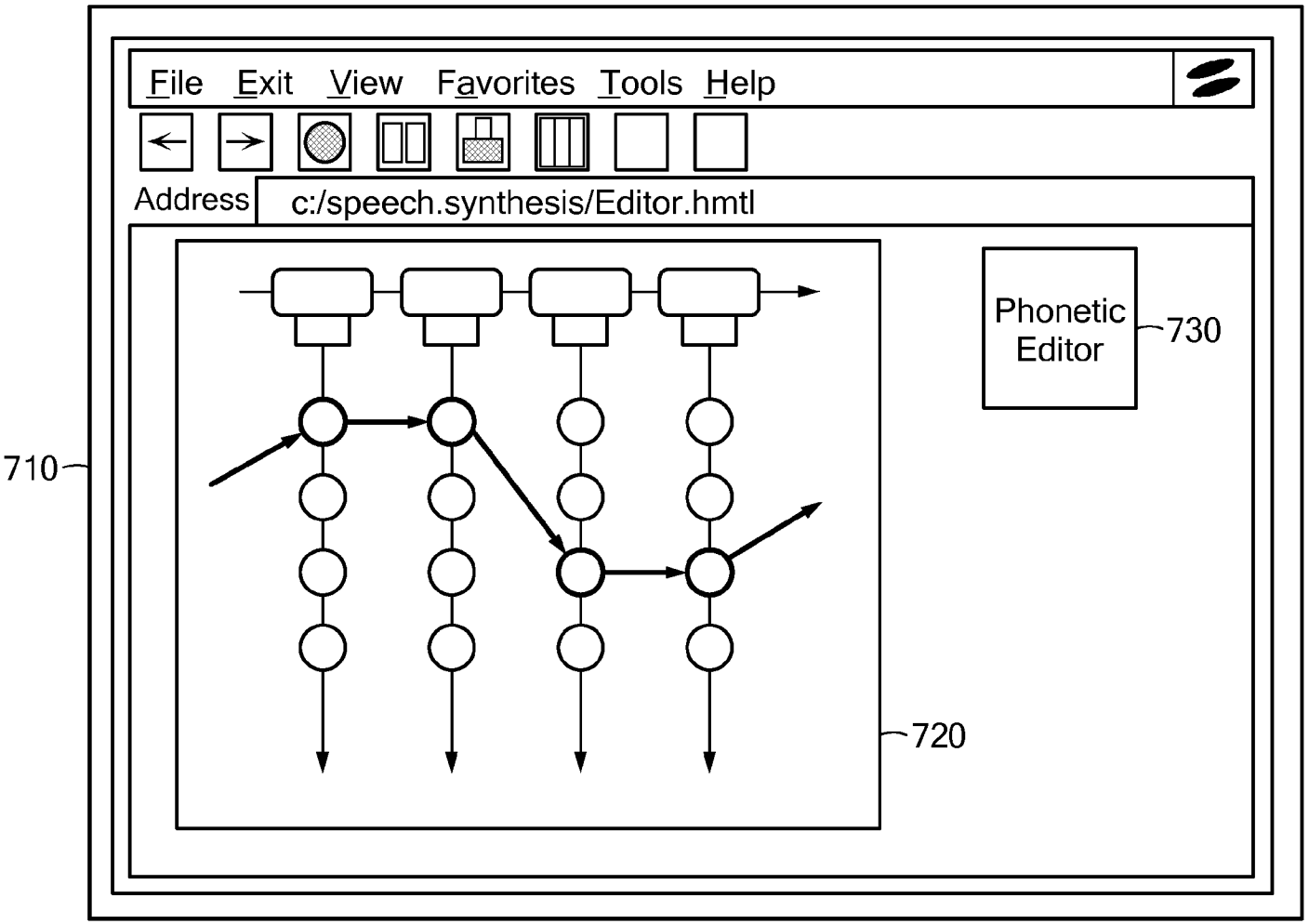
FIG. 7 depicts a second exemplary graphic page of the graphic user interface of FIG. 2 capable of displaying a designated portion of speech.

As discussed above, if an operator desires to edit a stream of synthesized speech, the operator can activate a particular control, such as the exemplary phonetic editor control 730 on the exemplary second GUI page 710 of FIG. 7. As shown in FIG. 7, the second page 710 includes a display portion 720 that can display the information of FIG. 6A or 6B as well as the phonetic editor control 730, which can cause the personal computer 200 undertake various editing processes useful to sculpt synthetic speech.

Figure 8:
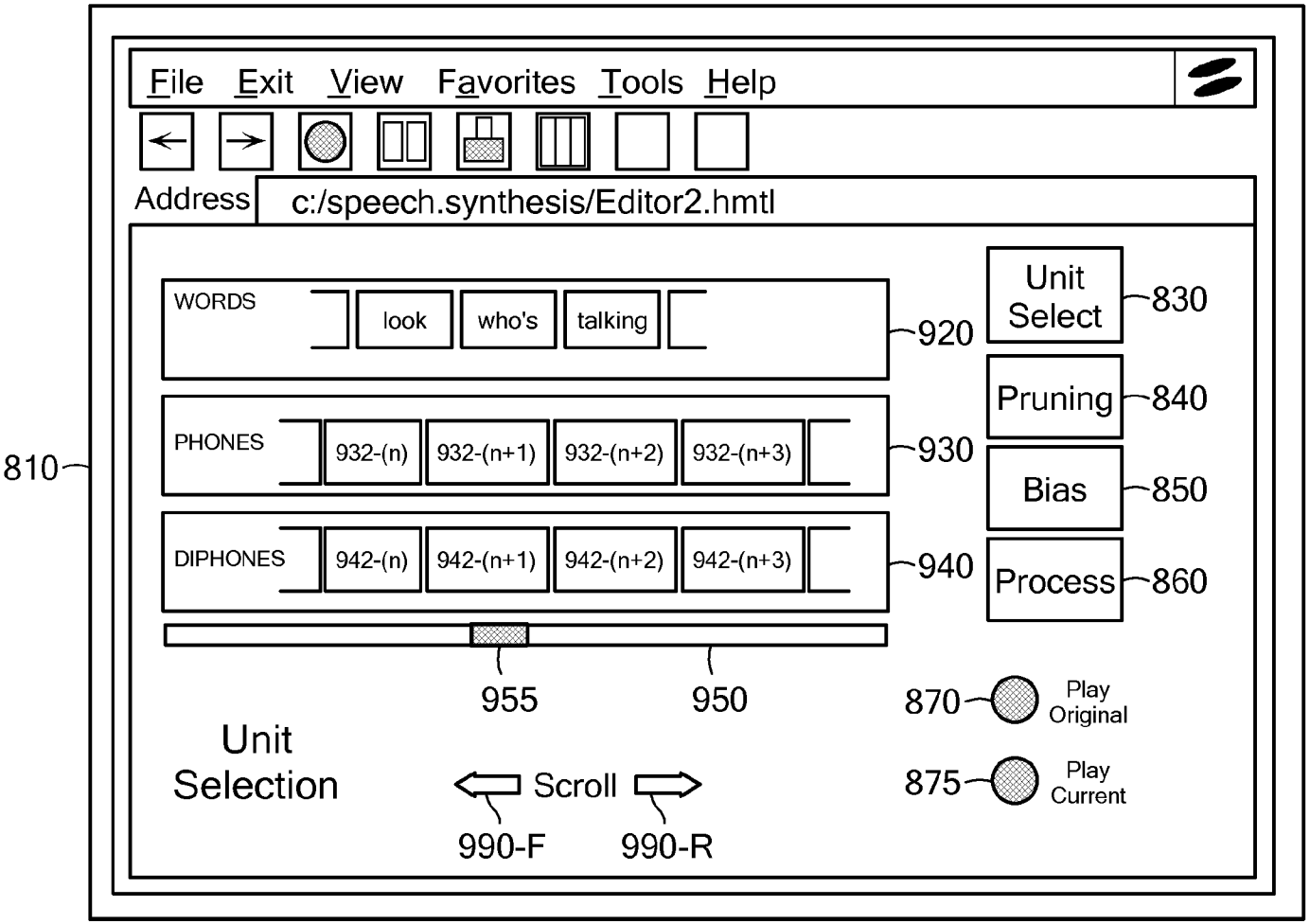
FIG. 8 depicts a third exemplary graphic page of the graphic user interface of FIG. 2 capable of selectively designating and removing various selected phonetic-units.

In response to activating the phonetic editor control 730, another GUI page configured to find problematic phonetic-units, such as the general editing/playback GUI page 810 of FIG. 8, can be provided to the operator. As shown in FIG. 8, the general editing/playback GUI page 810 includes a first, second and third display 920, 930 and 940.

The exemplary first display 920 can display a stream of symbols, such as virtual buttons with identifying text, that can allow an operator to view portions of text that has been synthesized.

The exemplary second display 930 can display a stream virtual buttons with identifying symbols {932(*n*) . . . 932(*n*+3)} that can represent various target phones derived from the text in display 920. For example, buttons {932(*n*) . . . 932(*n*+2)1 may represent three phones {/1/, /OO/, /k/} that can represent the word "look" (shown in display 920) with phone 932-3 representing a period of silence.

The exemplary third display 940 can display a stream virtual buttons with identifying text {942(*n*) . . . 942(*n*+3)1 that can represent various target diphones also derived from the text in display 920. For instance, using the example above, buttons {942(*n*) . . . 942(*n*+2)1 may represent a stream of diphones /silence-1/, /1-OO/, /OO-k/, /k-silence/ 1 that can also represent the word "look" shown in display 920.

In operation, the operator can scroll about a stream of text/speech by activating scroll controls 990-F and 990-R, which will cause the buttons in displays 920, 930 and 940 to scroll forward and backward in time to various text/speech portions of interest. As the operator scrolls, a timeline marker 955 embedded in a timeline display 950 can appropriately indicate where the displayed buttons of displays 920, 930 and 940 are positioned within the text/speech streams. As the operator scrolls, the operator may play the synthesized speech, in whole or in part, by activating control 870 to play a reference/original stream of speech, or by activating control 875 to play a stream of speech currently being edited. By using the various controls and visual feedback, an operator can identify problematic portions of speech (words/phones/diphones) that the operator may wish to edit.

As a convenience to an operator, the various word, phone and diphone buttons may be configured such that the operator can designate diphones of interest by pressing/activating buttons related to such diphones. Using the example above, assuming button 942-(*n*+1) in the diphone display 940 represents diphone /1-00/, the operator can designate diphone /1-00/ by activating button 942-(*n*+1).

However, by selecting button 932-(*n*+1) in the phone display 930 (representing phone /00/), all of the diphones related to button 932-(*n*+1), i.e., diphones {/1-OO/, /OO-k/}, can be designated. Similarly, by activating the word button marked "look", all diphones related to the word look {/silence-1/, /1-OO/, /OO-k/, /k-silence/} can be designated. Once designated, a phonetic-unit can be automatically or optionally removed from the stream of selected phonetic-units and precluded from further re-selection.

Upon designating a number of phonetic-units, the operator may wish to perform further sculpting operations. Accordingly, controls 830-860 are provided with control 830 causing the general editing/playback GUI page 810 to appear if pressed from another GUI page or to be otherwise refreshed.

Figure 9:
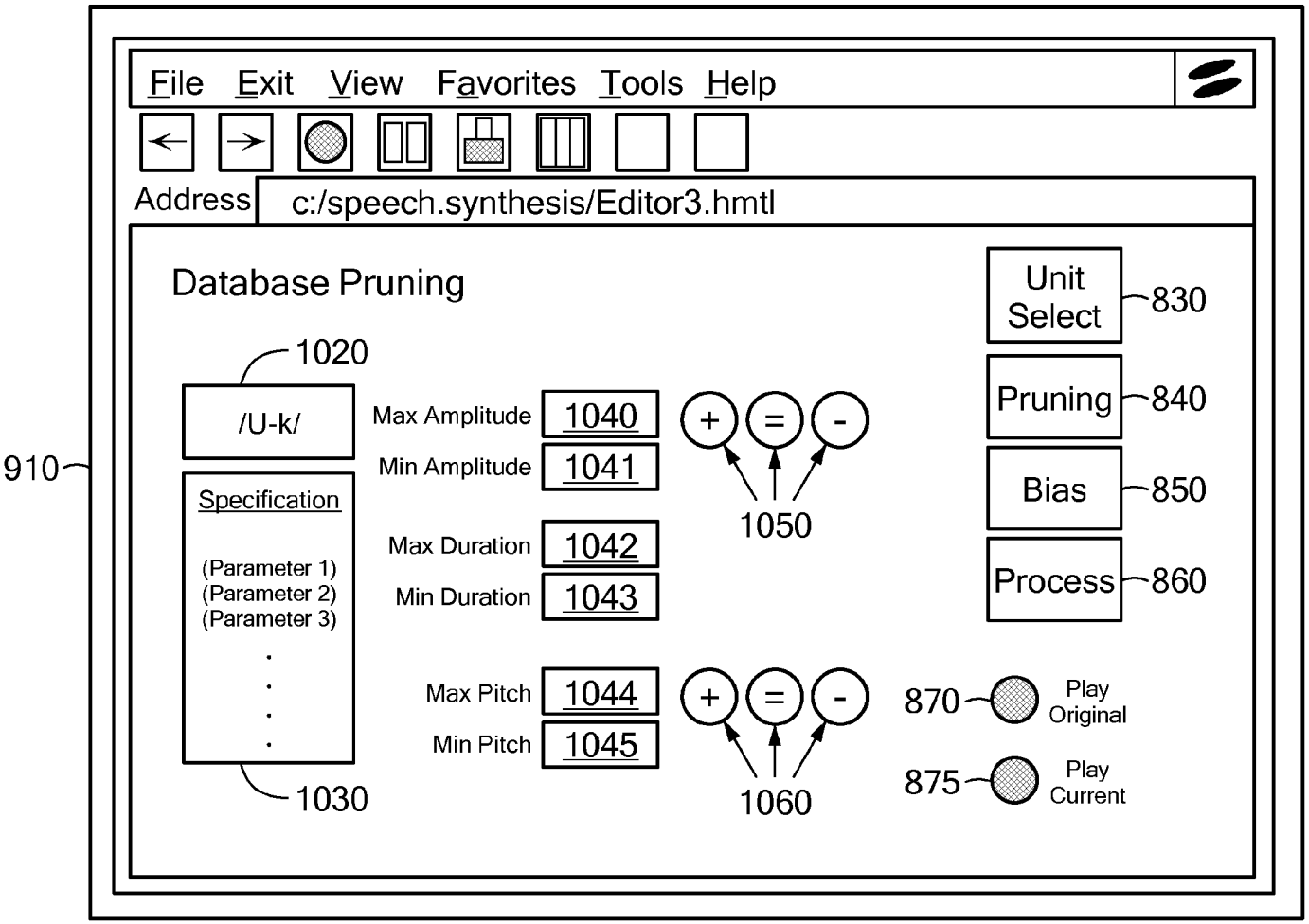
FIG. 9 depicts a fourth exemplary graphic page of the graphic user interface of FIG. 2 capable of pruning a group of sample phonetic-units relating to a particular selected phonetic-unit.
Figure 10:
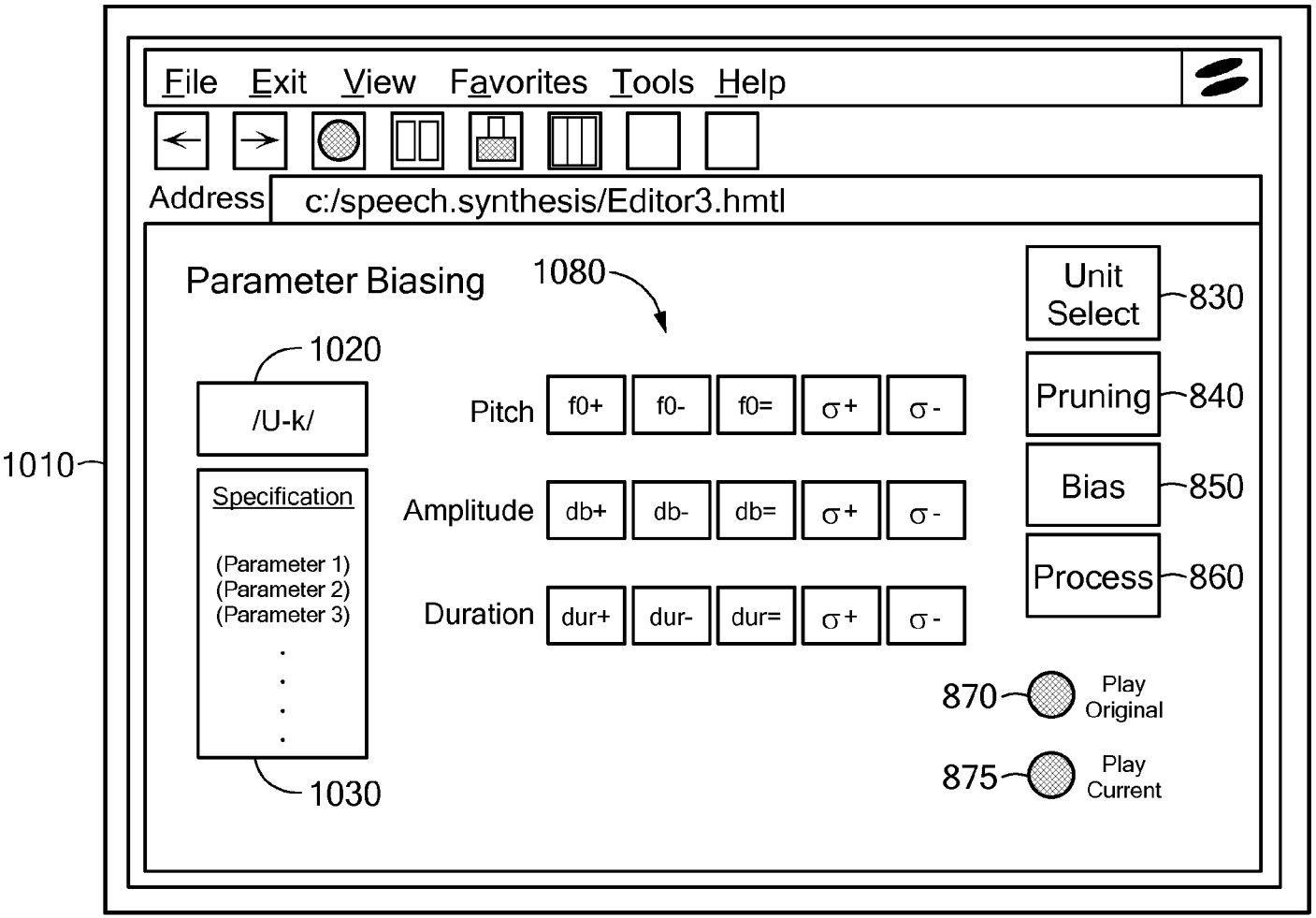
FIG. 10 depicts a fifth exemplary graphic page of the graphic user interface of FIG. 2 capable of biasing/editing a cost function.

Assuming the operator wishes to perform another unit-selection process, the operator can return to the general editing/playback GLT1 page 810 by activating control 860, which will cause another sample phonetic-unit to be selected to replace each removed phonetic-unit Assuming the operator activates control 840, a database pruning GUI page 910 of FIG. 9 can be activated to prune any number of phonetic-units from a group of selected phonetic-units. For example, given that the operator designates a particular instance of a diphone /U-k/, the operator using the database pruning GUI page 910 can selectively remove any number of phonetic-units from a group of sample phonetic-units related to the particular instance of diphone /U-k/.

To facilitate pruning, the exemplary database pruning GUI page 910 includes a phonetic display 1020 with respective specification window 1030, which can display all the particular parameters associated with the particular phonetic-unit shown in the phonetic display 1020. In various embodiments, the specification window 1030 can display the specification associated with a target phonetic-unit, a removed phonetic-unit, or both. By making such parameter information available, the database pruning GUI page 910 can provide information to an operator that can allow the operator to develop an intuitive "feel" of how the various parameters, such as parameters related to duration, pitch and amplitude, affect the quality and naturalness of an utterance.

Returning to FIG. 9, in the preferred embodiment, the operator may prune a phonetic-unit group by entering various maximum and minimum values for one or more of amplitude, duration and pitch in windows 1040-1045.

In other embodiments, the various entry windows 1040-1045 (or subsets thereof) can be eliminated and the (+) (=) (−) controls 1050 and 1060 can be used according to a more simple but straightforward paradigm, such that an operator can select one or any combination of the (+) (=) (−) controls 1050 and 1060 to prune phonetic-units having (amplitude, duration, pitch, etc.) values greater than, approximately equal to, or less than, the respective values of a particular selected/removed phonetic-unit. In similar embodiments, such (+) (=) (−) controls 1050 and 1060 can be used to prune phonetic-units having relative values greater than, approximately equal to, or less than, those values of a target phonetic-unit, as opposed to selected/removed phonetic-unit.

In this way a control can be used to prune phonetic units having a parameter value greater than, less than, or equal to, a reference phonetic-unit. Some embodiments may employ a combination of windows and controls for this purpose.

While the exemplary database pruning GUI page 910 is limited to pruning phonetic-units based on amplitude, duration and pitch, it should be appreciated that pruning can alternatively be based on any parameter useful for speech synthesis without departing from the scope of the present invention as defined in the claims.

After the operator performs one or more pruning operations, the operator can evoke another unit-selection process by activating control 860, then optionally compare the newly formed speech against the original speech (or other speech reference) by pressing play buttons 870 and 875 respectively. Alternatively, the operator can return to the general editing/playback GUI page 810 to designate/remove more phonetic-units by activating control 830, or optionally perform a biasing operation, i.e., edit a target cost-function, by activating button 850. Assuming that the operator activates button 850 to perform a biasing operation, a parameter biasing GUI page 1010 shown in FIG. 10 will be displayed to the operator. The parameter biasing GUI page 1010 contains the general controls 830-875 found in GUI pages 810 and 910, and the phonetic display 1020 and specification display 1030 of GUI page 910. The parameter biasing GUI page 1010 further includes a number of parameter biasing controls 1080, which can manipulate various cost functions between target phonetic-units and respective groups of sample phonetic-units, such as is discussed above in relation to FIGS. 5A-6B.

In operation, the operator can manipulate a cost-function by altering, for example, a pitch center-frequency by activating either the (10+) or (f0−) controls, which can bias the desired cost-function to select phonetic-units having a higher or lower center-frequency relative to the selected/removed phonetic-unit, or alternatively activate the (f0=−) control, which will bias the center-frequency to be the center frequency of the selected/removed phonetic-unit. For example, given a relevant selected/removed phonetic-unit has a center frequency of two-hundred hertz, the operator can bias the frequency cost-function to greater than two-hundred hertz in predetermined frequency increments by pressing the (10+) button. The operator may also similarly bias the pitch cost-function relative to the selected phonetic unit by activating either of the (a+) or (a−) controls, which will have the respective effects of making deviations in pitch more or less acceptable.

In other embodiments, the (10+), (10−), (a+) and (a−) controls can relate to biasing the desired cost-function relative to a target phonetic-unit as opposed to biasing relative to a selected/removed phonetic-unit. In still further embodiments, the above-mentioned controls can bias cost functions to relative to adjacent target or selected/removed phonetic-units, averages of various target and selected/removed phonetic-units or relative to any other phonetic-unit or combination of phonetic-units useable as a reference for relative biasing.

As with pitch, the exemplary parameter biasing GUI page 1010 can similarly be used to manipulate cost-functions related to amplitude and duration, or in some embodiments, a GUI page can be constructed to manipulate any other useful cost-function types. However, the particular type of cost-function, e.g., Gaussian, with respective parameters, e.g., center-point, may vary as desired in various embodiments without departing from the scope of the present invention as defined in the claims. Similarly, the specification parameters, such as a pitch parameter, as well as the form of related controls 1080, may also vary as desired without departing from the scope of the present invention as defined in the claims.

Figure 11A:
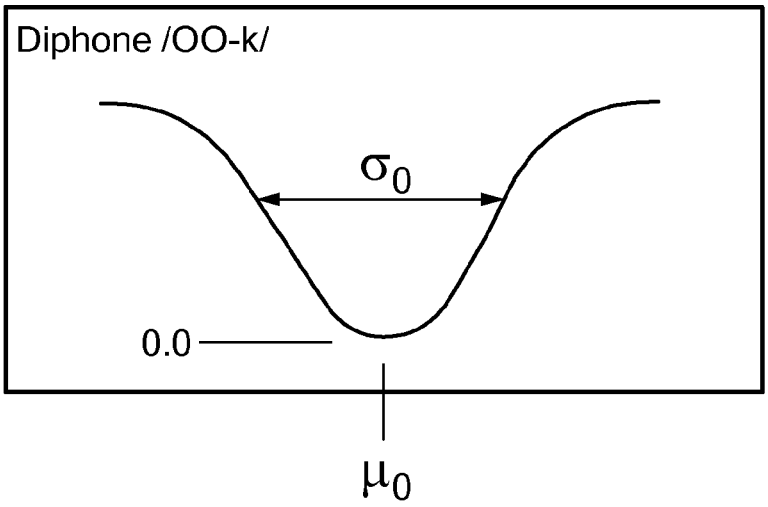
FIGS. 11A-11C depict a first exemplary cost function along with edited/biased versions of the first cost function.
Figure 11B:
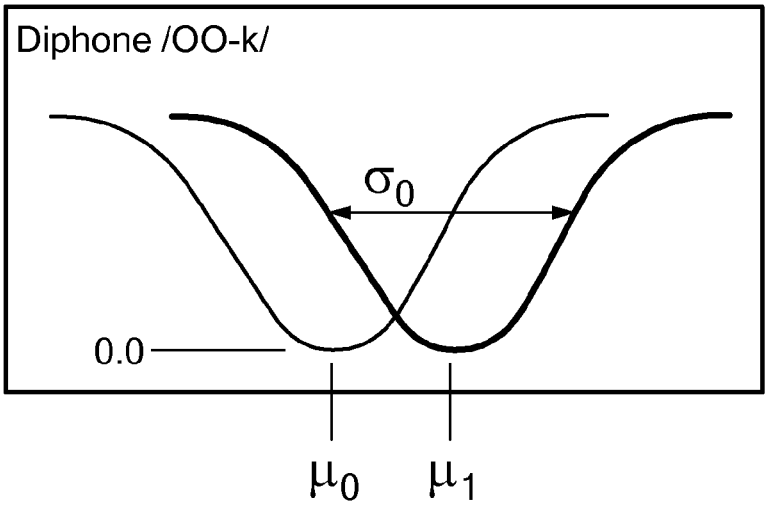
Figure 11C:
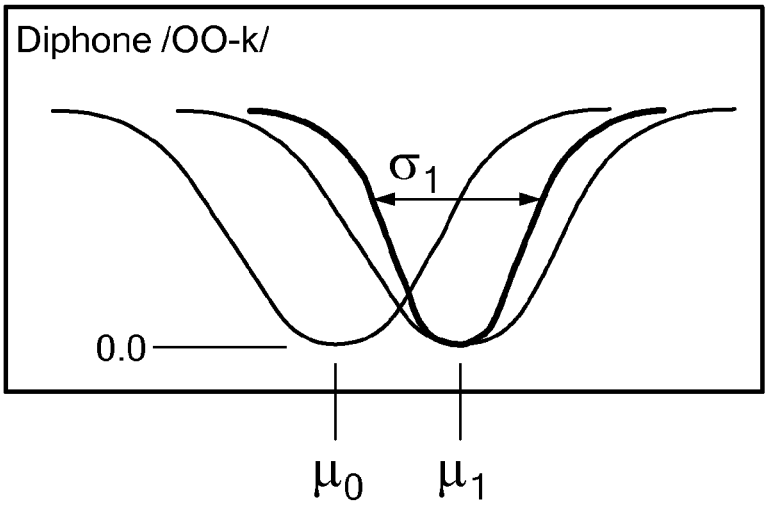

FIGS. 11A-11C depict a first exemplary target-cost function useful for speech selection and capable of being edited by an operator via a GUI page. As discussed above, costs functions can relate to any specification parameter useful for determining a stream of selected speech, and particular speech parameters, such as amplitude, duration and pitch, are generally more apt to human intuition than other parameters. As shown in FIG. 11A, the first cost-function is a Gaussian-shaped function centered about a center point $\mu_0$ and having a distribution (standard-deviation) $\sigma_0$. As shown in FIG. 11A, the second cost function is more appropriately described as an inverted Gaussian function described by parameters $[\mu_0, \sigma_0]$. That is, the second cost function is centered about point $\mu_0$ and has a Gaussian distribution $\sigma_0$. Certain classic probability distribution functions, such as Gaussian, Chi and Weibbel distributions, can be particularly useful as they have particularly well understood natures and are described and easily manipulated using a few variable parameters.

As shown in FIG. 11B, the cost function of FIG. 11A can be optionally edited/moved from center point $\mu_0$ to center point $\mu_1$. That is, because the cost function of FIG. 11A can be described using Gaussian parameters $[\mu, \sigma]$, the first cost function can be edited to conform to FIG. 11B by simply replacing parameter $\mu_0$ with $\mu_1$.

As further shown in FIG. 11C, the cost function of FIGS. 11A/11B can be further edited by changing the distribution of the Gaussian-shaped function. That is, the shape of the first cost function of FIGS. 11A/11B can be edited to conform to the shape (shown in bold) of FIG. 11C by replacing the distribution parameter $\sigma_0$ with $\sigma_1$.

Figure 12A:
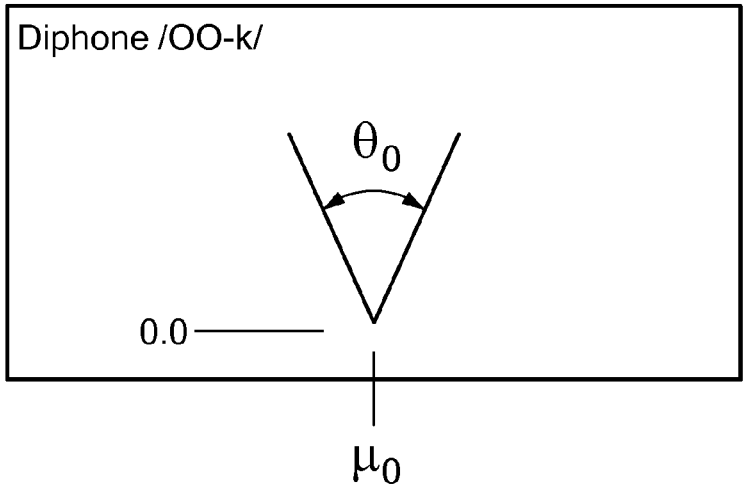
FIGS. 12A-12C depict a second exemplary cost function along with various edited/biased versions of the second cost function.
Figure 12B:
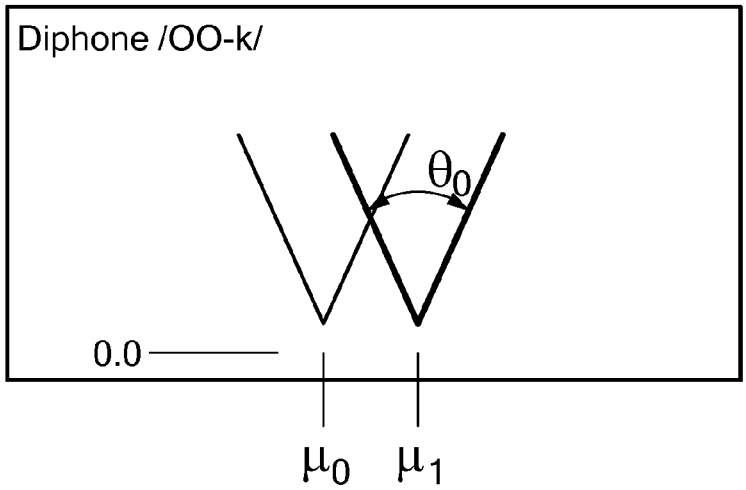
Figure 12C:
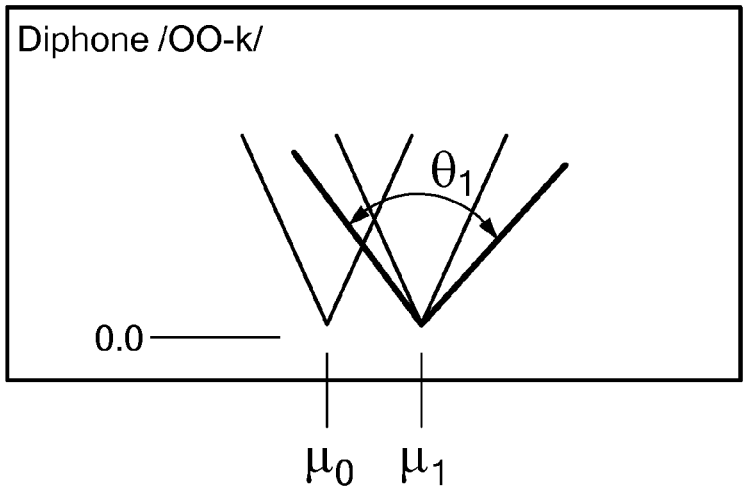

FIGS. 12A-12C depict a second exemplary target-cost function. As shown in FIGS. 12A-12C, the second cost function has a V-shape that can be described by parameters $[\mu, \theta]$. V-shaped cost functions can be particularly desirable due to their simple form and case of manipulation.

As shown in FIG. 12B, the cost function of FIG. 12A can be optionally edited/moved from center point $\mu_0$ to center point $\mu_1$. As further shown in FIG. 12C, the cost function of FIGS. 12A/12B can be further edited by changing the angular spread of the underlying V-shaped distribution by replacing parameter $\theta_0$ with $\theta_1$.

Figure 13B:
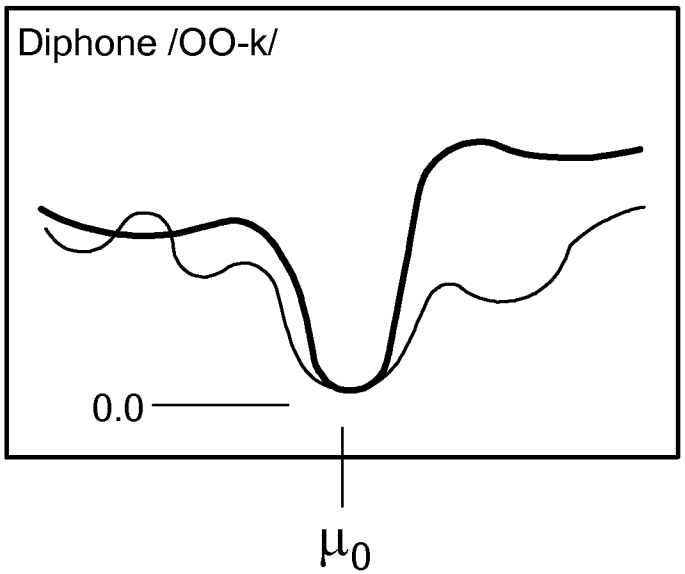
FIGS. 13A-13B depict a third exemplary cost function along with an edited/redrawn third cost function.
Figure 13A:
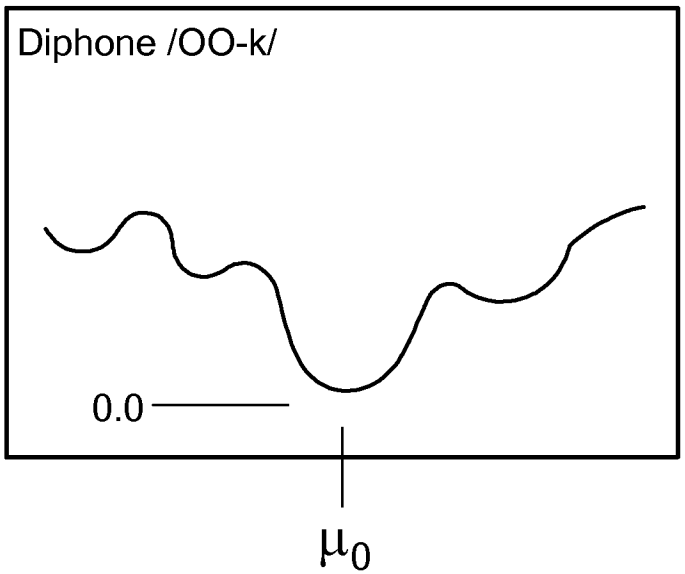

FIG. 13A depicts a third exemplary cost function useful as a target-cost function in speech selection and capable of being edited by an operator using a GUI page. As shown in FIG. 13A, the third cost function is not apparently based on any set of parameters or any discernible, well-described function, i.e., the function of FIG. 13A appears non-parametric. As the particular form of a given cost function may sometimes be based on experimental data, determined by an operator or determined according to a complex set of pre-determined rules, it should be appreciated that cost functions may not lend themselves to a form well described by a set of parameters. Accordingly, when such a cost function cannot easily be described as a parametric function, such as those functions of FIGS. 11A and 12A, alternative editing methods can be used without departing from the scope of the present invention as defined in the claims.

FIG. 13B depicts an exemplary alternative editing process performed on the cost function of FIG. 13A. As shown in FIG. 13B, the edited cost function does not resemble the original cost function, but is redrawn completely using any number of tools useable by an operator. For example, in various exemplary embodiments, an operator can select a number of discrete points and evoke a computer-based algorithm to join the points using splines or a similar numeric technique. In other embodiments, the operator can redraw the cost function by passing a stylus over a pressure sensitive screen or by directing a computer-mouse or trackball. In still other embodiments, costs functions can be redrawn in part using sophisticated morphing tools that can stretch, flatten or reshape a particular cost function in whole or in part. Whether splines, morphing or other particular redrawing technique be used, any such editing technique shall be said to redraw a cost function, in whole or in part, for the purposes of FIGS. 13A and 13B.

While the particular editing processes outlined in FIGS. 13A and 13B are particularly useful for complex non-parametric functions, it should be appreciated that the same approach can nonetheless be used for well-described parametric functions, such as those of FIGS. 11A to 12C. Accordingly, it should be appreciated that the particular tools and methodology used to redraw a cost function can vary as desired without regard to the underlying nature of a cost function.

Figure 14:
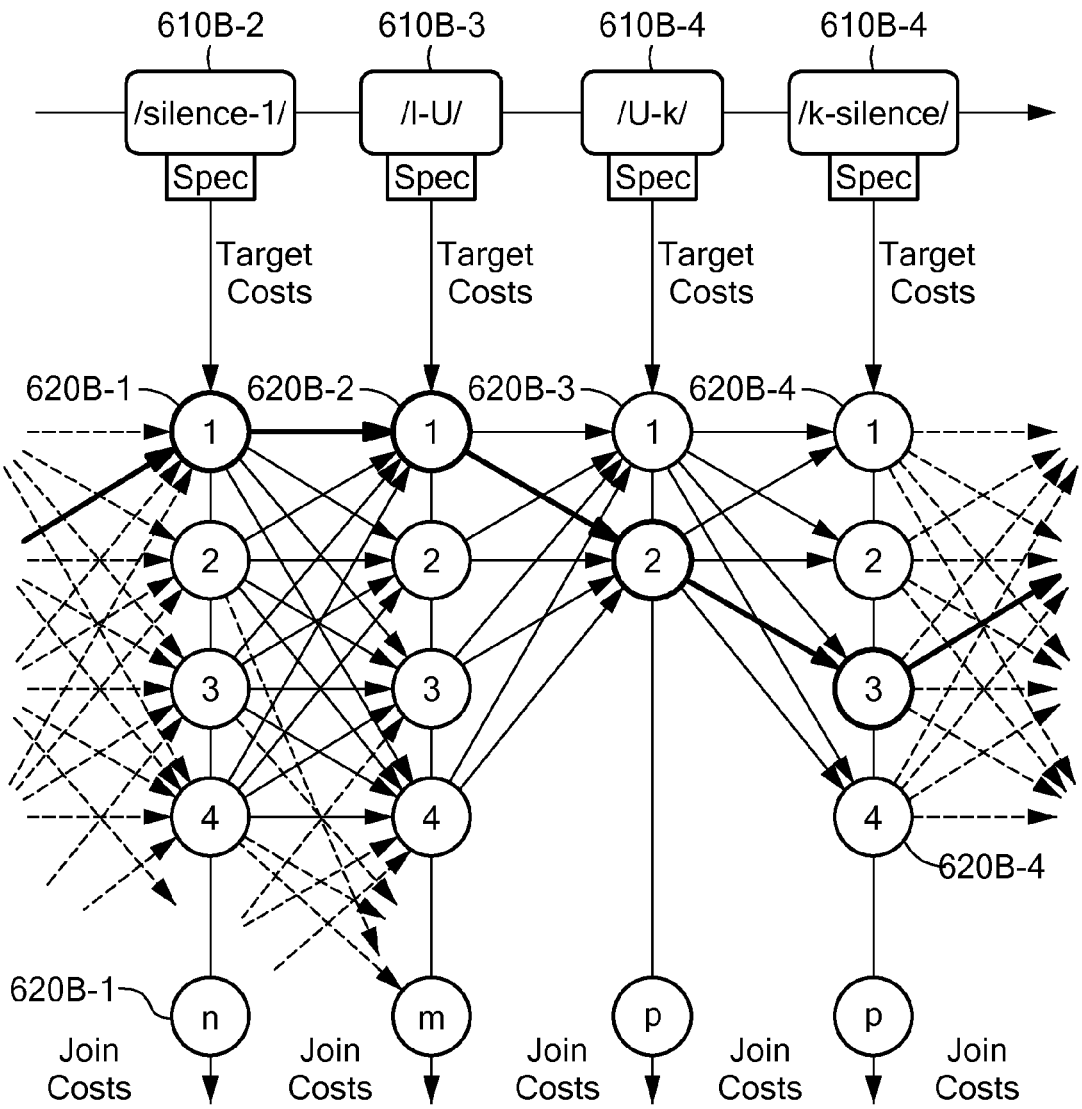
FIG. 14 depicts the stream of exemplary target diphones of FIG. 5B after a second unit-selection process selects a second stream of sample diphones.

FIG. 14 depicts an alternate stream of selected diphones derived from the stream of diphones depicted in FIG. 6B. As shown in FIG. 14, sample diphones 620B-3(3) and 620B-3(4) have been removed from group 620B-3, and a subsequent unit-selection process has selected a new sequence of diphones 620B-1(1), 620B-2(1), 620B-3(2), 620B-3(3) 1. As discussed above, the unit-selection process used to create the exemplary alternate stream of selected diphones can consists of any number of steps including selective unit-designation/removal, pruning and biasing steps.

Figure 15:
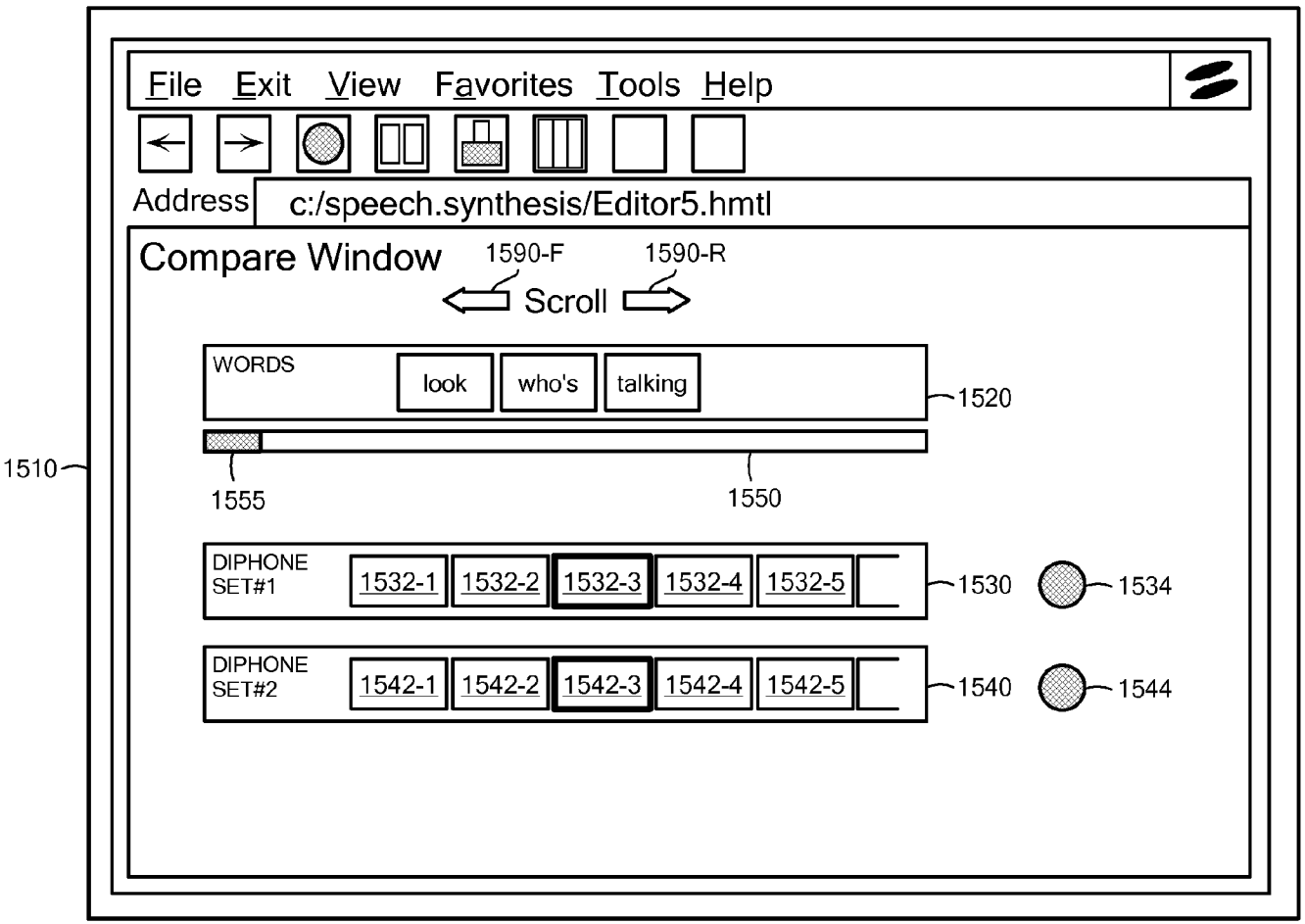
FIG. 15 depicts a sixth exemplary graphic page of the graphic user interface of FIG. 2 capable of comparing two streams of synthetic speech.

FIG. 15 is a comparison GUI page 1510 capable of displaying a first set of selected diphones {1532-1 . . . 1532-5} synthesized from a stream of text (displayed in window 1530), along with a second set of selected diphones {1542-1 . . . 1542-51} (displayed in window 1530) similarly synthesized from the same stream of text, but incorporating different sample diphones.

As with the GUI page of FIG. 8, the comparison GUI page 1510 also includes scrolling controls 1590-F and 1590-R, a word display window 1520 and a timeline marker 1555 embedded in a timeline display 1550. The comparison GUI page 1510 still further includes playback controls 1534 and 1544 to play the first and second streams of synthesized speech respectively.

Figure 16:
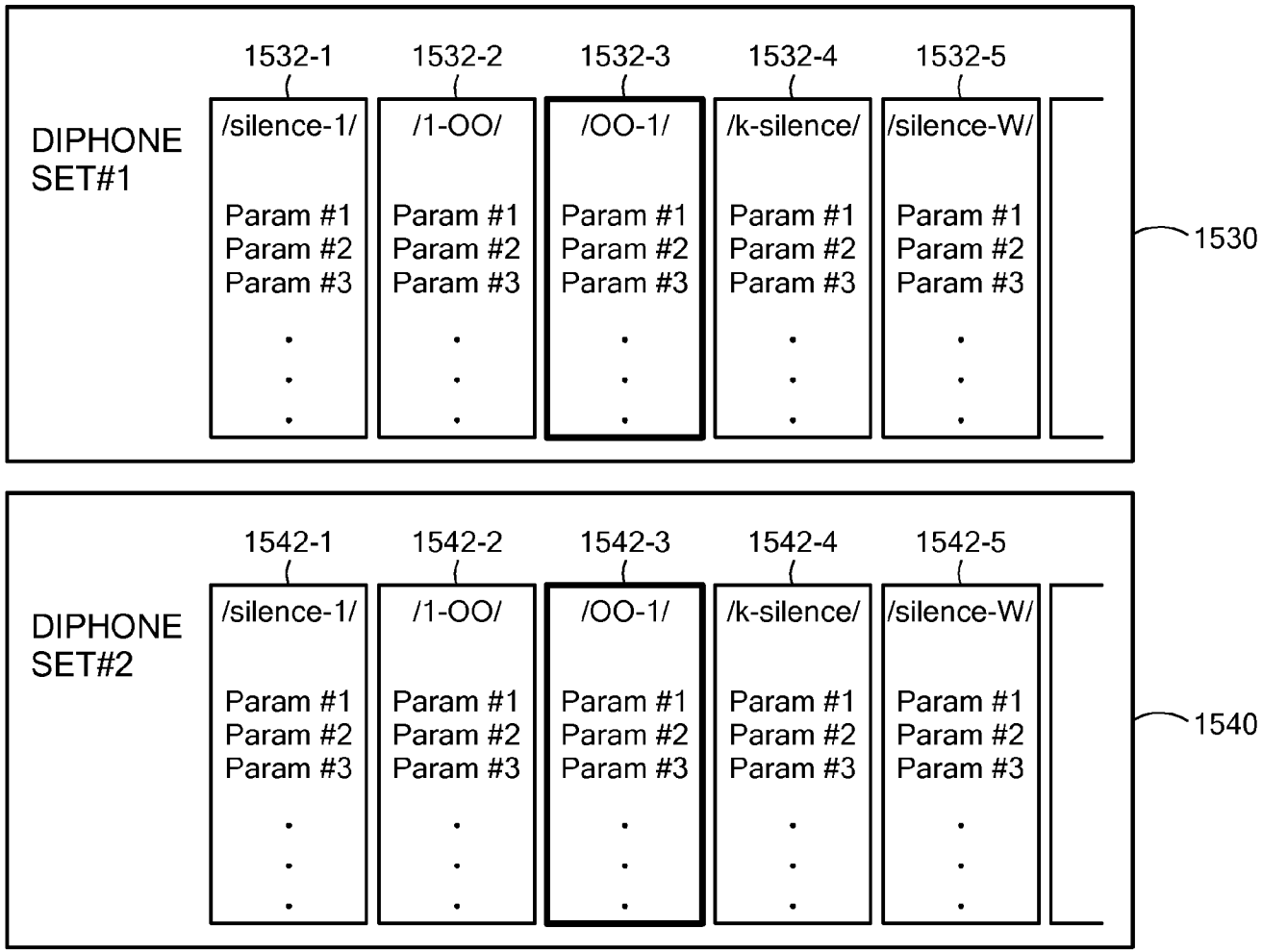
FIG. 16 depicts details of the diphone streams of FIG. 15.

FIG. 16 depicts details of display windows 1530 and 5540. As shown in FIG. 16, each selected diphone {1532-1 . . . 1532-51} or {1542-1 . . . 1542-51} is displayed accompanied by a number of relevant parameters so that an operator can compare each stream of synthesized speech and gauge the effect each parameter for each diphone may have of the quality of each speech output. Accordingly, such a comparison GUI page 1510 can help the operator develop an intuitive sense of the relationship between phonetic-unit parameters and speech quality. While the exemplary comparison GUI page 1510 of FIGS. 15 and 16 can accommodate two variants of a speech streams at a time, it should be appreciated that, in some embodiments, any number of different speech streams can be simultaneously displayed without departing from the scope of the present invention as defined in the claims.

Figure 17:
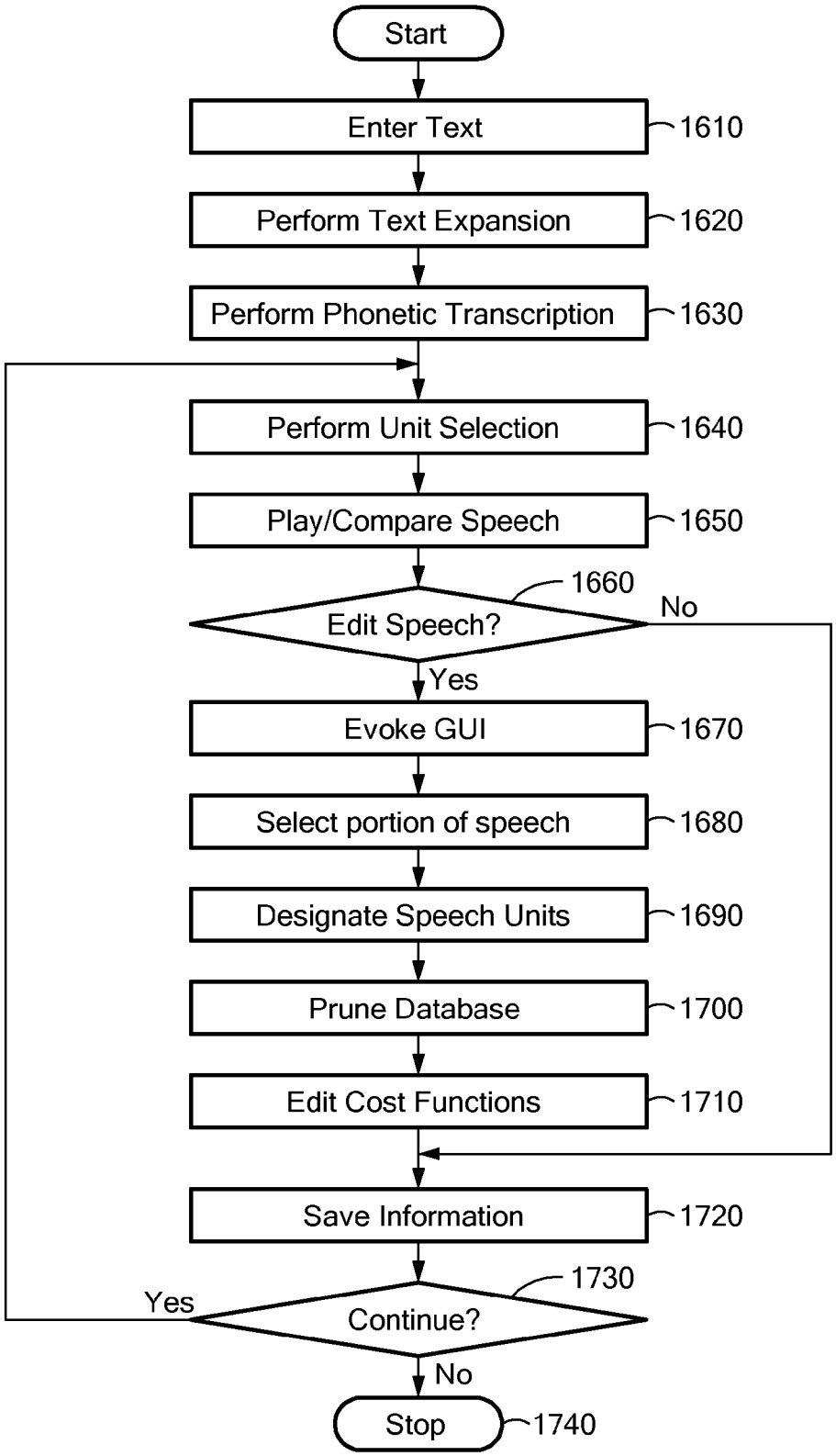
FIG. 17 is a flowchart outlining an exemplary process for sculpting synthesized speech according to the present invention.

FIG. 17 is a flowchart outlining an exemplary process for sculpting a stream of artificial speech according to the present invention. The process starts in step 1610 where a stream of text is provided. As discussed above, the term "text" can refer to a set of alpha-numeric characters, or can alternatively refer to any other set of symbols or information useful for representing speech, without departing from the scope of the present invention as defined in the claims. Next, in step 1620, a text expansion process is performed on the stream of text to provide a stream of expanded text. Then, in step 1630, a phonetic transcription process is performed on the stream of expanded text to provide a stream of target phonetic-units. Control continues to step 1640.

In step 1640, a unit-selection process is performed on the stream of target phonetic-units using a database of sample phonetic-units to provide a stream of selected phonetic-units. As discussed above, the exemplary unit-selection process can use a Viterbi-based least-cost technique across a lattice of the sample phonetic-units to provide the stream of selected phonetic-units. However, it should be again appreciated that any technique useful for unit-selection can be used without departing from the scope of the present invention as defined in the claims. Next, in step 1650, the stream of selected phonetic-units is converted to mechanical speech, i.e. "played", for the benefit of an operator who can judge the quality of the mechanical speech, and optionally compared to another stream of synthesized speech. Control continues to step 1660.

In step 1660, a determination is made by the operator as to whether to edit, or "sculpt", at least a portion of the stream of synthesized speech. If the speech is to be sculpted, control continues to step 1670; otherwise, control jumps to step 1720.

In step 1670, a graphic user interface capable of enabling the operator to sculpt the speech is evoked. Next, in step 1680, a specific portion of the stream of speech is selected to be viewed. Then, in step 1690, one or more phonetic-units are designated to be removed. Control continues to step 1700.

In step 1700, various phonetic-units from each group of related phonetic-units designated in step 1690 are optionally pruned. Next, in step 1710, various target-cost functions related to the designated phonetic-units can be optionally edited/biased. As discussed above, a particular edited cost function can relate to any of various speech parameters and especially to those speech parameters that an operator can intuitively perceive, such as duration, amplitude, pitch and the like, without departing from the scope of the present invention as defined in the claims.

Further as discussed above, the form of editing can vary depending on the nature of the cost functions. For example, cost functions having a particular distribution that can be described by a number of parameters, such as a "V" shaped distribution or Gaussian distribution, can be edited by varying the applicable distribution parameters using tools as simple as an array of biasing buttons. Also as discussed above, certain cost distributions that aren't easily modeled by known distribution functions can be redrawn or otherwise morphed/reshaped by an operator. Again, the particular editing tools and methodology for cost function editing can vary as required or otherwise desired without departing from the scope of the present invention as defined in the claims. Control continues to step 1720.

In step 1720, the various information produced by the preceding steps, such as information relating to the stream of selected phonetic-units or information relating to any edited phonetic-units and costs functions, can be saved for distribution or further editing. Accordingly, after the editing session has ended, an operator can later retrieve the information at his convenience and play or optionally edit the speech according to steps 1240-1320 above. Alternatively, the operator can produce and save multiple renditions of a given sentence and later make relative comparisons between the renditions using tools such as the comparison GUI page 1510 of FIG. 15.

In step 1730, a determination is made to continue the editing process. If the speech is to be further edited, control jumps back to step 1640; otherwise, control continues to step 1740 where the process stops. The cycle of unit-selecting, determining/comparing speech quality and editing can continue until speech quality is deemed satisfactory or an operator otherwise decides to stop the sculpting process.

Embodiments of the invention may be implemented in whole or in part in any conventional computer programming language such as VHDL, SystemC, Verilog, ASM, etc. Alternative embodiments of the invention may be implemented as pre-programmed hardware elements, other related components, or as a combination of hardware and software components.

Embodiments can be implemented in whole or in part as a computer program product for use with a computer system. Such implementation may include a series of computer instructions fixed either on a tangible medium, such as a computer readable medium (e.g., a diskette, CD-ROM, ROM, or fixed disk) or transmittable to a computer system, via a modem or other interface device, such as a communications adapter connected to a network over a medium. The medium may be either a tangible medium (e.g., optical or analog communications lines) or a medium implemented with wireless techniques (e.g., microwave, infrared or other transmission techniques). The series of computer instructions embodies all or part of the functionality previously described herein with respect to the system. Those skilled in the art should appreciate that such computer instructions can be written in a number of programming languages for use with many computer architectures or operating systems. Furthermore, such instructions may be stored in any memory device, such as semiconductor, magnetic, optical or other memory devices, and may be transmitted using any communications technology, such as optical, infrared, microwave, or other transmission technologies. It is expected that such a computer program product may be distributed as a removable medium with accompanying printed or electronic documentation (e.g., shrink wrapped software), preloaded with a computer system (e.g., on system ROM or fixed disk), or distributed from a server or electronic bulletin board over the network (e.g., the Internet or World Wide Web). Of course, some embodiments of the invention may be implemented as a combination of both software (e.g., a computer program product) and hardware. Still other embodiments of the invention are implemented as entirely hardware, or entirely software (e.g., a computer program product).

Although various exemplary embodiments of the invention have been disclosed, it should be apparent to those skilled in the art that various changes and modifications can be made which will achieve some of the advantages of the invention without departing from the true scope of the invention.

What is claimed is:

1. A speech processor, comprising:

a unit-selection device that processes a stream of target phonetic-units to produce a stream of respective selected phonetic-units, the selected phonetic-units being selected on the basis of at least a set of target-cost functions that determine target-costs between each target phonetic-unit and respective groups of sample phonetic-units; and a phonetic editor configured to:

i. enable an operator to selectively designate one or more selected phonetic-units in the stream of selected phonetic-units, ii. automatically remove the one or more designated phonetic units from the stream of selected phonetic-units, and iii. prune one or more non-selected phonetic-units each of which relates to the same phonetic-unit group as a first removed selected phonetic unit.

2. A speech processor as in claim 1, wherein the one or more removed phonetic-units is precluded from re-selection by a subsequent unit-selection process.

3. A speech processor as in claim 1, wherein the phonetic editor is further configured to edit at least a first target-cost function.

4. A speech processor as in claim 3, wherein the phonetic editor is configured to change at least one or more parameters of the first target-cost function.

5. A speech processor as in claim 4, wherein the one or more parameters includes at least one of a center point and a standard deviation.

6. A speech processor as in claim 3, wherein the edited target-cost function is at least one of a duration function, a pitch function, and an amplitude function.

7. A speech processor as in claim 1, wherein the phonetic editor is configured to enable an operator to compare two or more streams of speech with at least one stream of speech generated using one or more editing functions.

8. A speech processor as in claim 1, wherein the unit-selection device is enabled to select a new selected phonetic-unit to replace at least one removed phonetic-unit.

9. A method for processing speech information, comprising:

selecting a stream of selected phonetic-units from a database of sample phonetic-units, wherein the step of selecting is based on a stream of target phonetic-units with respective target-costs relating to the sample phonetic-units; and performing an editing function on the stream of selected phonetic-units, the editing function including:

i. selectively designating one or more selected phonetic-units, ii. automatically removing the one or more designated phonetic units from the stream of selected phonetic-units, and iii. pruning one or more non-selected phonetic-units each of which relates to the same phonetic-unit group as a first removed selected phonetic unit.

10. A method as in claim 9, wherein performing an editing function includes editing at least one cost function.

11. A method as in claim 10, wherein performing an editing function includes changing at least one or more parameters of a target-cost function.

12. A method as in claim 11, wherein the one or more parameters include at least one of a center point and a standard deviation.

13. A method as in claim 11, wherein the edited target-cost function is selected from one of a duration function, a pitch function and an amplitude function.

14. A method as in claim 11, wherein the step of pruning comprises entering a value in a window of the graphic user interface.

15. A method as in claim 11, wherein the step of pruning comprises defining a pruning threshold having regard to a reference phonetic-unit.

16. A method as in claim 9, wherein the step of editing the at least one cost function includes re-drawing some or all of the cost function.

* * * * *